US005600056A

United States Patent [19]

Hasegawa et al.

[11] Patent Number: 5,600,056

[45] Date of Patent: Feb. 4, 1997

[54] AIR/FUEL RATIO DETECTION SYSTEM FOR MULTICYLINDER INTERNAL COMBUSTION ENGINE

[75] Inventors: Yusuke Hasegawa; Isão Komoriya; Yoichi Nishimura, all of Wako, Japan

[73] Assignee: Honda Giken Kogyo Kabushiki Kaisha, Tokyo, Japan

[21] Appl. No.: 463,639

[22] Filed: Jun. 6, 1995

[30] Foreign Application Priority Data

Jun. 20, 1994 [JP] Japan ..... 6-160533

[51] Int. Cl.[6] ..... F01N 3/20

[52] U.S. Cl. ..... 73/23.32; 73/117.2

[58] Field of Search ..... 73/23.31, 23.32, 73/117.2, 116, 117.3; 60/274, 276, 277

[56] References Cited

U.S. PATENT DOCUMENTS 5,391,282 2/1995 Miyashita et al. .

FOREIGN PATENT DOCUMENTS 59-101562 6/1984 Japan .

1-313644 12/1989 Japan .

5-30966 5/1993 Japan .

5-180059 7/1993 Japan .

7-83094 3/1995 Japan .

*Primary Examiner*—Richard Chilcot

*Assistant Examiner*—Eric S. McCall

*Attorney, Agent, or Firm*—Nikaido Marmelstein Murray & Oram LLP

[57] ABSTRACT

An air/fuel ratio detection system for a multicylinder internal combustion engine having an air/fuel ratio sensor installed at the exhaust system confluence point of the engine. The sensor outputs are successively stored in buffers. In the engine, the distances of the individual cylinder exhaust ports to the sensor are different for all cylinders, which affects the air/fuel ratio detection. Moreover, the engine operating conditions also affect the detection. For that reason, mapped data called timing maps are prepared for the individual cylinders to be retrieved according to the engine speed and manifold absolute pressure for sampled data selection. The timing maps enable the system to select one from among sampled data which approximates the actual behavior of the air/fuel ratio at the confluence point in response to the distances from the cylinder exhaust port to the sensor and the operating conditions of the engine.

57 Claims, 19 Drawing Sheets

AIR/FUEL RATIO DETECTION SYSTEM FOR MULTICYLINDER INTERNAL COMBUSTION ENGINE

BACKGROUND OF THE INVENTION

1. Field of the Invention

This invention relates to an air/fuel ratio detection system for a multicylinder internal combustion engine, more particularly to a system which can select one from among a plurality of outputs of an air/fuel ratio sensor sampled at a most optimum timing under the engine operating conditions even when the distances of the individual cylinder exhaust ports to the sensor are not equal for each cylinder and based on the sampled datum, to detect the air/fuel ratios of the individual cylinders correctly.

2. Description of the Prior Art

It is a common practice to install an air/fuel ratio sensor in the exhaust system of an internal combustion engine to detect the air/fuel ratio at that location. A system of this type is taught by Japanese Laid-Open Patent Application No. Sho 59(1984)-101,562, for example. Similarly, the assignee earlier proposed designing a model describing the behavior of the exhaust system detected by an air/fuel ratio sensor disposed at the exhaust confluence point, and designing an observer for estimating the air/fuel ratios at the individual cylinders based on the confluence point air/fuel ratio. (Japanese Laid-open Patent Application No. Hei 5(1993)-180,059 which was filed in the United States under the number of 07/997,769). Moreover, Japanese Laid-open Patent Application Hei 1(1989)-313,644 proposes a technique in which the appropriateness of air/fuel detection is checked at every predetermined crank angular position.

In the air/fuel ratio detection, since the remaining burned gas in a cylinder is swept out by the piston in the course of an exhaust stroke, the behavior of the air/fuel ratio at the exhaust system confluence point of a multicylinder internal combustion engine is conceived to be synchronous with the TDC (Top Dead Center) crank positions. When the air/fuel ratio sensor is installed at the exhaust system confluence point, it therefore becomes necessary to sample outputs of the sensor synchronized with the TDC crank positions. However, depending on the sampling timings, the control unit of the air/fuel detection system recognizes the air/fuel ratio as having a different value. Specifically, assume that the actual air/fuel ratio at the exhaust confluence point relative to the TDC crank position is that as illustrated in FIG. 26. As illustrated in FIG. 27, the air/fuel ratio sampled at inappropriate timings is recognized by the control unit as being quite different from that sampled at appropriate (best) timings. The sensor outputs should preferably be sampled at a timing which is able to reflect the change of the sensor output faithfully, in other words, the sensor outputs should preferably be sampled at a timing as close as possible to a turning point such as a peak of sensor outputs.

Further, the air/fuel ratio changes differently depending on the length of the arrival time at which the exhaust gas reaches the sensor, or depending on the reaction time of the sensor. The arrival time varies depending on the pressure and/or volume of the exhaust gas, etc. Furthermore, since, to sample sensor outputs synchronized with the TDC crank position means to conduct sampling on the basis of crank angular position, the sampling is not independent from engine speed. Thus, detection of the air/fuel ratio greatly depends on the operating conditions of the engine. For that reason, the aforesaid prior art system (1(1989)-313,644) discriminates at every predetermined crank angular position as to whether not the detection is appropriate. The prior art system is, however, complicated in structure and disadvantageous in that the discrimination becomes presumably impossible at a high engine speed since it requires a long calculation time. Further, there is the likelihood that, when a suitable detection timing is determined, the turning point of the sensor output will have already passed.

Furthermore, when the engine is a multicylinder internal combustion engine, the air/fuel ratio sensor is installed at, or downstream of, the confluence point of the exhaust manifold of the engine. Depending on the configuration of the exhaust manifold of the engine, it sometimes happens that the distances between the individual cylinder exhaust ports and the air/fuel ratio sensor are not the same for each cylinder or combination of cylinders. For example, when the engine is a V-type six-cylinder engine having two three-cylinder banks as will be explained with reference to FIG. 1, the respective cylinders do not always have equal distances from their exhaust ports to the air/fuel ratio sensor. As a result, the exhaust gas generated at a cylinder closer to the sensor arrives at the air/fuel ratio sensor at a time earlier than that generated at a less close cylinder, provided that the operating conditions of the engine remain unchanged.

It is therefore impossible to obtain a proper value when the sampled data selection is carried out paying attention only to the operating conditions of the engine, if the distance to the air/fuel ratio sensor is not uniform for all cylinders of the engine.

This invention is accomplished in view of the foregoing problems and has as its object to provide an air/fuel detection system for a multicylinder internal combustion engine which can select one from among the sampled outputs of an air/fuel ratio sensor that reflects faithfully the actual behavior of the air/fuel ratio at the exhaust confluence point and to detect or determine the air/fuel ratio of the engine even when the distances from the cylinder exhaust ports to the air/fuel ratio sensor are not equal and are different for some or all of the cylinders, thereby enhancing detection accuracy.

Another object of the invention is to provide an air/fuel ratio detection system for a multicylinder internal combustion engine which can select one from among sampled outputs consecutively generated by an air/fuel ratio sensor that reflects faithfully the actual behavior of the air/fuel ratio at the exhaust confluence point, and to determine the air/fuel ratio for the individual cylinders of the engine even when the distances from the cylinder exhaust ports to the air/fuel ratio sensor are not equal and are different for some or all of the cylinders, thereby making it possible to carry out cylinder-by-cylinder air/fuel ratio control for the engine.

Still another object of the invention is to provide an air/fuel ratio detection system for a multicylinder internal combustion engine which can select one from among sampled outputs consecutively generated by an air/fuel ratio sensor that reflects faithfully the actual behavior of the air/fuel ratio at the exhaust confluence point even when the distances from the cylinder exhaust ports to the air/fuel ratio sensor are not equal and are different for some or all of the cylinders and which is simple in structure.

For realizing these objects, the present invention provides a system for detecting air/fuel ratio of an internal combustion engine having a plurality of cylinders by sampling outputs of an air/fuel ratio sensor installed at a confluence point of an exhaust system of said engine, including engine operating condition detecting means for detecting operating condition of said engine, sampling means for sampling said outputs of said air/fuel ratio sensor, characteristic determining means for determining a characteristic for datum selection with respect to said operating condition of said engine, selecting means for selecting one from among said sampled data by retrieving said determined characteristic by said detected operating condition of said engine, and determining means for determining said air/fuel ratio of said engine based on said selected sampled datum. The characteristic features of the system is that said engine is provided with an exhaust manifold connected to said plurality of cylinders and having said confluence point where said air/fuel ratio sensor is installed in such a manner that distance from the air/fuel ratio sensor to the exhaust port of at least one cylinder in said group is different from that of the other cylinder, said characteristic determining means determines said characteristic for datum selection with respect to said operating condition of said engine and said distance to said air/fuel ratio sensor, and said selecting means selects one from among said sampled data by retrieving said determined characteristics by said detected operating condition of said engine and said distance to said air/fuel ratio sensor.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
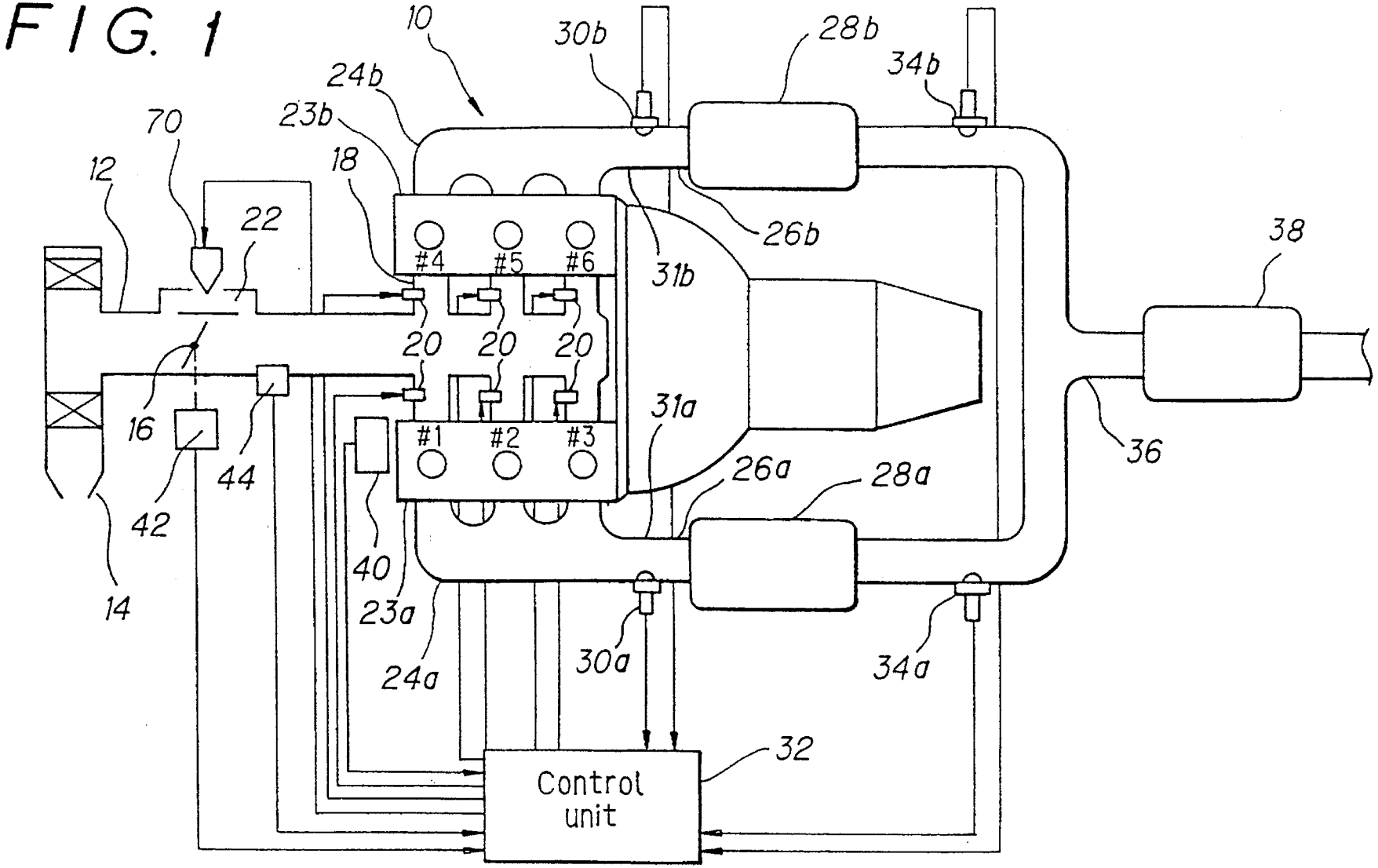
FIG. 1 is an overall schematic view of an air/fuel ratio detection system for a multicylinder internal combustion engine according to the present invention.

FIG. 1 is an overall schematic view of an air/fuel ratio detection system for a multicylinder internal combustion engine according to this invention.

Reference numeral 10 in this figure designates a V-type six-cylinder internal combustion engine having two three-cylinder banks. Air drawn in through an air cleaner 14 mounted on the far end of an air intake passage 12 is supplied to the first (#1) to sixth (#6) cylinders through an intake manifold 18 while the flow thereof is adjusted by a throttle valve 16. A fuel injector 20 for injecting fuel is installed in the vicinity of an intake valve (not shown) of each cylinder. The injected fuel mixes with the intake air to form an air-fuel mixture that is ignited in the associated cylinder by a spark plug (not shown). The resulting combustion of the air-fuel mixture drives down a piston (not shown). The air intake path 12 is provided with a secondary path 22 in the vicinity of the throttle valve 16.

As stated earlier, the engine 10 has two cylinder banks 23*a*, 23*b*. The first bank 23*a* has a first combination of three exhaust pipes 24*a* that extend from exhaust ports (not shown) of #1 to #3 cylinders respectively and merge into one pipe portion 26*a*. The second bank 23*b* has a second combination of three exhaust pipes 24*b* that extend from exhaust ports (not shown) of #4 to #6 cylinders respectively and merge into one pipe portion 26*b*. The exhaust gas produced by the combustion is discharged through an exhaust valve (not shown) and the exhaust port into either of the first or second combination of exhaust pipes 24*a* or 24*b*, from where it passes through the pipe portion 26*a* or 26*b* to a three-way catalytic converter 28*a* or 28*b* where noxious components are removed therefrom before being discharged to the exterior. In each bank 23*a* or 23*b*, an air/fuel ratio sensor 30*a* or 30*b* constituted as an oxygen concentration detector is provided at a confluence point 31*a* or 31*b* where the pipes 24*a* or 24*b* extending from the exhaust ports of cylinders #1, #2, #3 or #4, #5, #6 merge into one. Each air/fuel ratio sensor 30*a* or 30*b* detects the oxygen concentration of the exhaust gas at the confluence point 31*a* or 31*b* and produces outputs proportional thereto over a broad range extending from the lean side to the rich side. As this air/fuel ratio sensor is explained in detail in the assignee's earlier U.S. Pat. No. 5,391,282, it will not be explained further here. Hereinafter, the air/fuel ratio sensor will be referred to as a "LAF" sensor (linear A-by-F sensor) or a "wide-range" sensor. The outputs of the LAF sensors 30*a* or 30*b* are forwarded to a control unit 32.

In each pipe portion 26*a* or 26*b*, an $O_2$ sensor 34*a* or 34*b* is provided downstream of the catalytic converter 28*a* or 28*b* and generates an ON/OFF signal switching at the stoichiometric air/fuel ratio in response to the oxygen concentration in the exhaust gas. The two pipe portions 26*a*, 26*b* merge into one at a point downstream of the position at which the $O_2$ sensors are respectively situated. The exhaust manifold made up of the first and second combination of exhaust pipes 24*a*, 24*b* and the pipe portions 26*a*, 26*b* is followed by an exhaust pipe 36. A third three-way catalytic converter 38 is provided in the exhaust pipe 36.

As illustrated, the distances from respective cylinders, more correctly the exhaust ports of the respective cylinders to the air/fuel ratio sensor 30*a* or 30*b* are different for each cylinder and is not the same for all cylinders.

A crank angle sensor 40 for detecting the piston crank angles is provided in an ignition distributor (not shown) of the engine 10. The crank angle sensor 40 produces a TDC signal at every TDC crank position and a CRK signal at every 20 crank angles (will be shown as "stage" in FIG. 3) obtained by dividing the TDC interval by 6. And a throttle position sensor 42 is provided for detecting the degree of opening of the throttle valve 16, and a manifold absolute pressure sensor 44 is provided for detecting the pressure Pb, indicative of the engine load, in the intake air passage 12, downstream of the throttle valve 16 as an absolute pressure.

Figure 2:
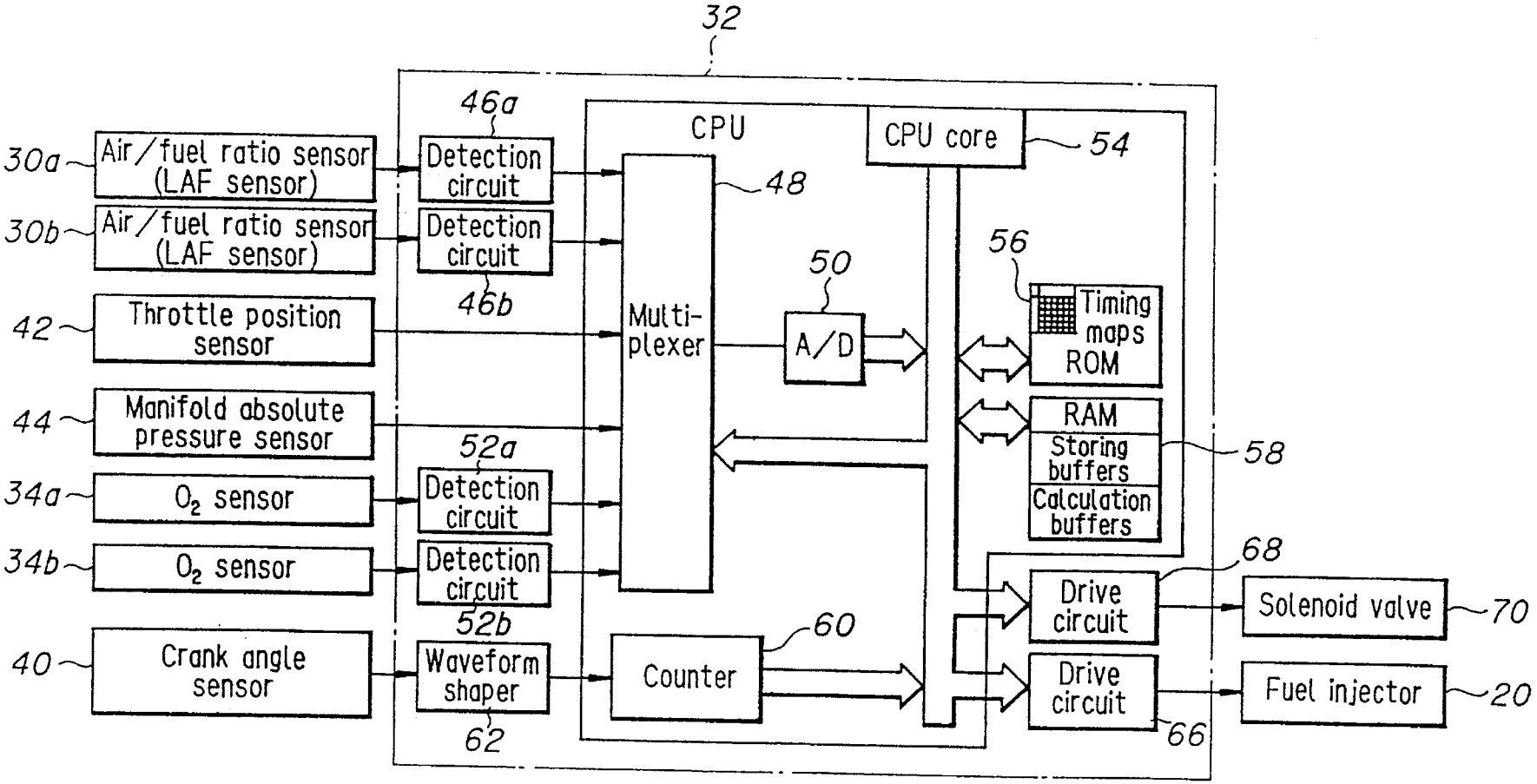
FIG. 2 is a block diagram showing the details of a control unit illustrated in FIG. 1.

Details of the control unit 32 are shown in the block diagram of FIG. 2 focussing on the air/fuel ratio detection. As illustrated, the outputs of the LAF sensor 30*a*, 30*b* are received by detection circuits 46*a*, 46*b*. The outputs of the detection circuits 46*a*, 46*b* are sent to a CPU and are input to an A/D (analog/digital) converter 50 through a multiplexer 48. Similarly, the outputs of the 02 sensor 34*a*, 34*b* are input to the CPU through detection circuits 52*a*, 52*b*. The CPU comprises a CPU core 54, a ROM (read-only memory) 56, a RAM (random access memory) 58 and a counter 60. In addition, the outputs of the throttle position sensor 42 etc. are input to the CPU through the multiplexer 48 to the A/D converter 50. And the output of the crank angle sensor 40 is shaped by a waveform shaper 62 and has its output values counted by the counter 60 to determine the engine speed Ne. The result of the count is input to the RAM 58, together with the other A/D converted values. In accordance with commands stored in the ROM 56, the CPU core 54 uses the detected or determined values to compute a manipulated variable, and drives the fuel injector 20 of the respective cylinders via a drive circuit 66 for controlling fuel injection and drives a solenoid valve 70 via a second drive circuit 68 for controlling the amount of secondary air passing through the bypass 22 shown in FIG. 1.

Figure 3:
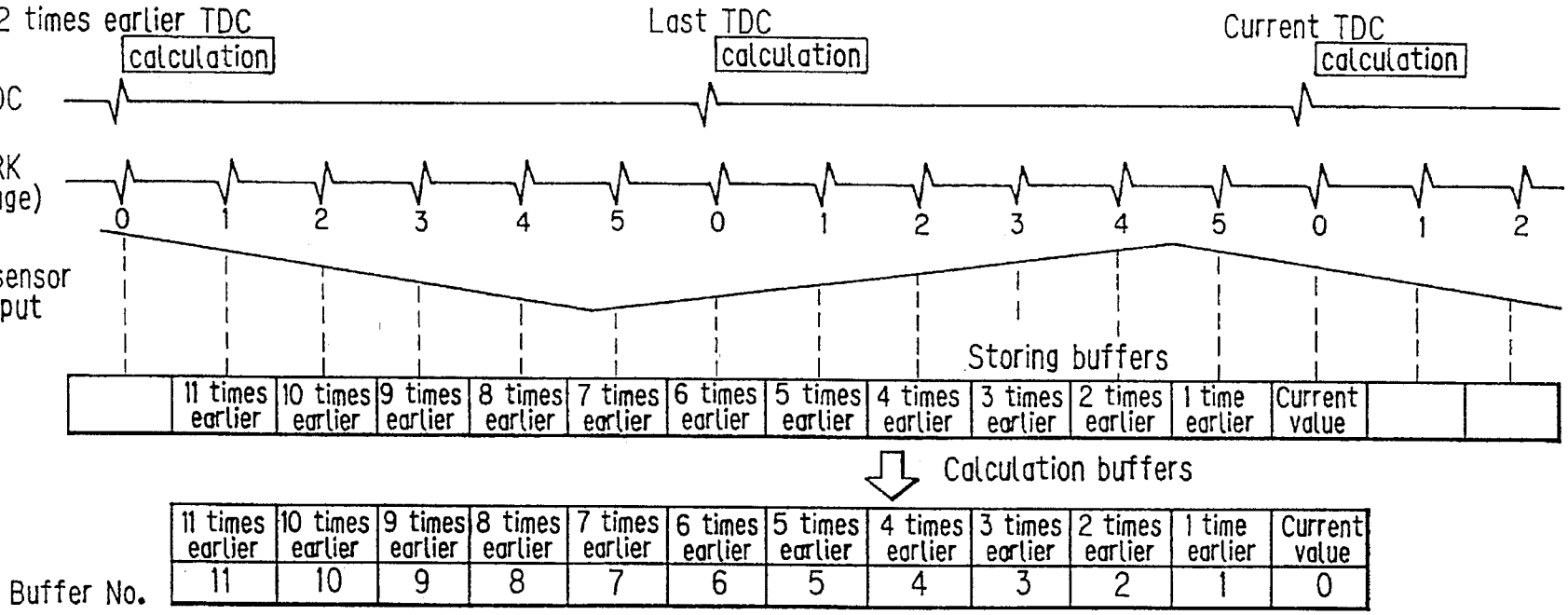
FIG. 3 is a timing chart showing sampling of the air/fuel ratio sensor illustrated in FIG. 1.

The ROM 56 has timing maps for sampled data selection which will later be explained in detail, and the RAM 58 has 12 storing buffers and 12 calculation buffers. As illustrated in FIG. 3, the A/D values of the respective LAF sensor outputs are first stored in the storing buffers each time the CRK signal is input from the crank angle sensor 40. The stored LAF sensor outputs are shifted to the calculation buffers at one time at a predetermined crank angle position. The 12 calculation buffers are assigned with numbers (No. 0 to No.–11) and are identified. The sampling is carried out separately in the LAF sensors 30*a*, 30*b* provided at the two banks 23*a*, 23*b*. In FIG. 3, only the sampling at the first LAF sensor 23*a* is shown. Although not shown, the sampling at the second LAF sensor 23*b* is quite the same.

Figure 4:
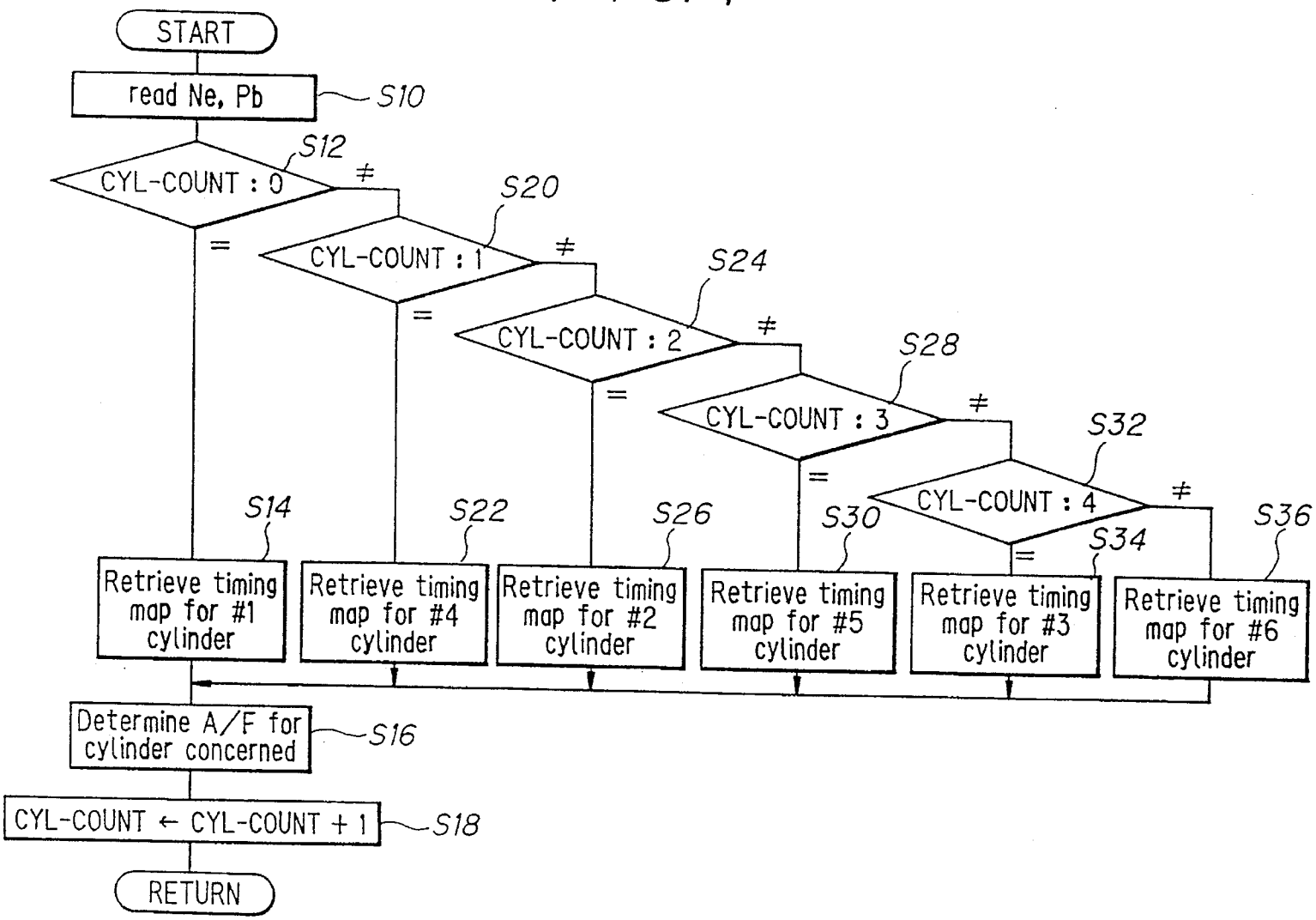
FIG. 4 is a flowchart showing the operation of the air/fuel ratio detection system according to the invention illustrated in FIG. 1.

The operation of the system is shown by the flowchart of FIG. 4. Since, however, the system is based on a mathematical model which describes the behavior of the exhaust system which inputs the output from the LAF sensor, and on an observer which observes the internal state of the model such that air/fuel ratios in the individual cylinders are estimated from an output of the observer, before entering the explanation of the flowchart, the air/fuel ratio estimation through the observer will be described first. Although this will be described for a four-cylinder engine, the below will apply equally to a six-cylinder engine, as will be apparent as the explanation goes.

Figure 5:
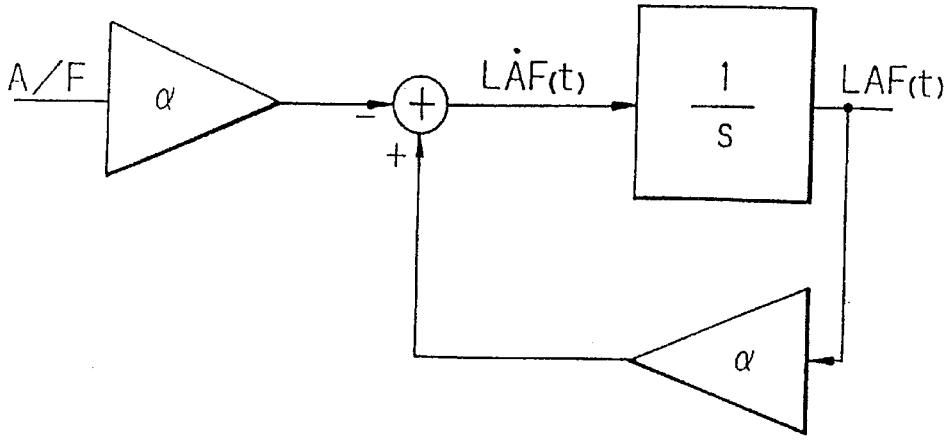
FIG. 5 PRIOR ART
FIG. 5 is a block diagram showing a model which describes the behavior of detection of the air/fuel ratio referred to in the assignee's earlier application.

For high-accuracy separation and extraction of the air/fuel ratios in the individual cylinders from the output of a single LAF sensor, it is necessary to first accurately ascertain the detection response delay (lag time) of the LAF sensor. The inventors therefore simulated this delay using a first-order lag time system as a model. For this they designed the model shown in FIG. 5. Here, if we define LAF: LAF sensor output, and A/F: input air/fuel ratio, the state equation can be written as:

$$\dot{LAF}(t)=\alpha LAF(t)-\alpha A/F(t) \quad (1)$$

When this is discretized for period delta T, we get:

$$LAF(k+1)=\hat{\alpha}LAF(k)+(1-\hat{\alpha})A/F(k) \quad (2)$$

Here, $\hat{\alpha}$ is the correction coefficient and is defined as:

$$\hat{\alpha}=1+\alpha\Delta T+(1/2!)\alpha^2\Delta T^2+(1/3!)\alpha^3\Delta T^3+(1/4!)\alpha^4\Delta T^4$$

Figure 6:
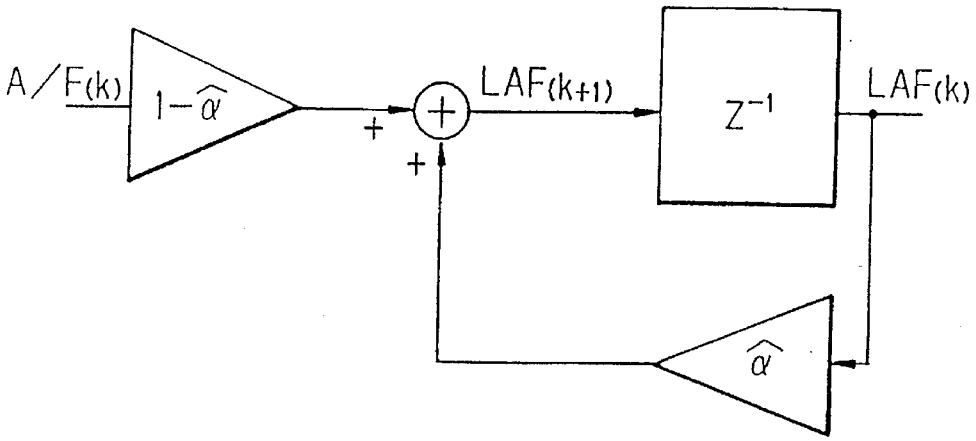
FIG. 6 PRIOR ART
FIG. 6 is a block diagram which shows the model of FIG. 5 discretized in the discrete-time series for a period delta T.

Equation 2 is represented as a block diagram in FIG. 6.

Therefore, Equation 2 can be used to obtain the actual air/fuel ratio from the sensor output. That is to say, since Equation 2 can be rewritten as Equation 3, the value at time k−1 can be calculated back from the value at time k as shown by Equation 4.

$$A/F(k)=\{LAF(k+1)-\hat{\alpha}LAF(k)\}/(1-\hat{\alpha}) \quad (3)$$

$$A/F(k-1)=\{LAF(k)-\hat{\alpha}LAF(k-1)\}/(1-\hat{\alpha}) \quad (4)$$

Figure 7:
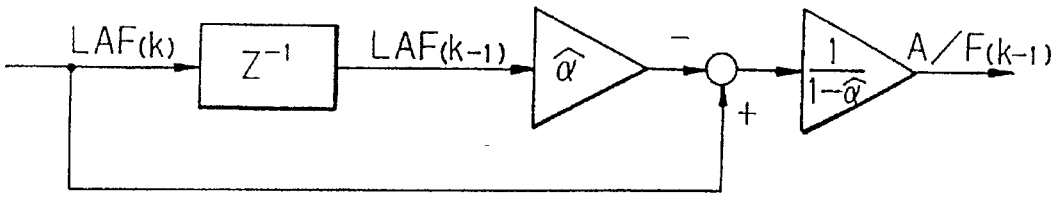
FIG. 7 PRIOR ART
FIG. 7 is a block diagram which shows a real-time air/fuel ratio estimator based on the model of FIG. 6.

Specifically, use of the Z transformation to express Equation 2 as a transfer function gives Equation 5, and a real-time estimate of the air/fuel ratio input in the preceding cycle can be obtained by multiplying the sensor output LAF of the current cycle by the inverse transfer function. FIG. 7 is a block diagram of the real-time air/fuel ratio estimator.

$$t(z)=(1-\hat{\alpha})/(Z-\hat{\alpha}) \quad (5)$$

The method for separating and extracting the air/fuel ratios in the individual cylinders based on the actual air/fuel ratio obtained in the foregoing manner will now be explained. If the air/fuel ratio at the confluence point of the exhaust system is assumed to be an average weighted to reflect the time-based contribution of the air/fuel ratios in the individual cylinders, it becomes possible to express the air/fuel ratio at the confluence point at time k in the manner of Equation 6. (As F (fuel) was selected as the manipulated variable, the fuel/air ratio F/A is used here. For easier understanding, however, the air/fuel ratio will sometimes be used in the explanation. The term "air/fuel ratio" (or "fuel/air ratio") used herein is the actual value corrected for the response lag time calculated according to Equation 5.)

$$\begin{aligned}
[F/A](k) &= C_1[F/A\#_1] + C_2[F/A\#_3] + C_3[F/A\#_4] + C_4[F/A\#_2] \\
[F/A](k+1) &= C_1[F/A\#_3] + C_2[F/A\#_4] + C_3[F/A\#_2] + C_4[F/A\#_1] \\
[F/A](k+2) &= C_1[F/A\#_4] + C_2[F/A\#_2] + C_3[F/A\#_1] + C_4[F/A\#_3] \\
&\ \ \vdots
\end{aligned} \tag{6}$$

Figure 8:
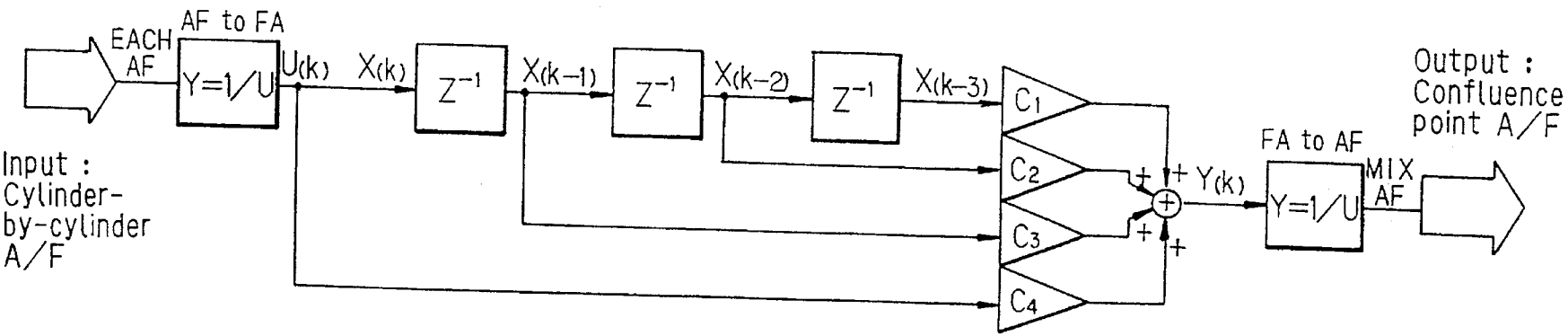
FIG. 8 PRIOR ART
FIG. 8 is a block diagram showing a model which describes the behavior of the exhaust system of the engine referred to in the assignee's earlier application.

More specifically, the air/fuel ratio at the confluence point can be expressed as the sum of the products of the past firing histories of the respective cylinders and weighting coefficients C (for example, 40% for the cylinder that fired most recently, 30% for the one before that, and so on). This model can be represented as a block diagram as shown in FIG. 8.

Its state equation can be written as:

$$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \tag{7}$$

Further, if the air/fuel ratio at the confluence point is defined as y(k), the output equation can be written as:

$$y(k) = [c_1\ c_2\ c_3] \begin{pmatrix} x(k-3) \\ x(k-2) \\ x(k-1) \end{pmatrix} + c_4 u(k) \tag{8}$$

Here:

$c_1$:0.05, $c_2$:0.15, $c_3$:0.30, $c_4$:0.50

Since u(k) in this equation cannot be observed, even if an observer is designed from the equation, it will still not be possible to observe x(k). Thus, if one defines x(k+1)=x(k−3) on the assumption of a stable operating state in which there is no abrupt change in the air/fuel ratio from 4 TDCs earlier (i.e., from that of the same cylinder), Equation 9 is obtained. This will be the same when u(k) is defined as a desired air/fuel ratio.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} \tag{9}$$

$$y(k) = [c_1\ c_2\ c_3\ c_4] \begin{pmatrix} x(k-3) \\ x(k-2) \\ x(k-1) \\ x(k) \end{pmatrix}$$

Figure 9:
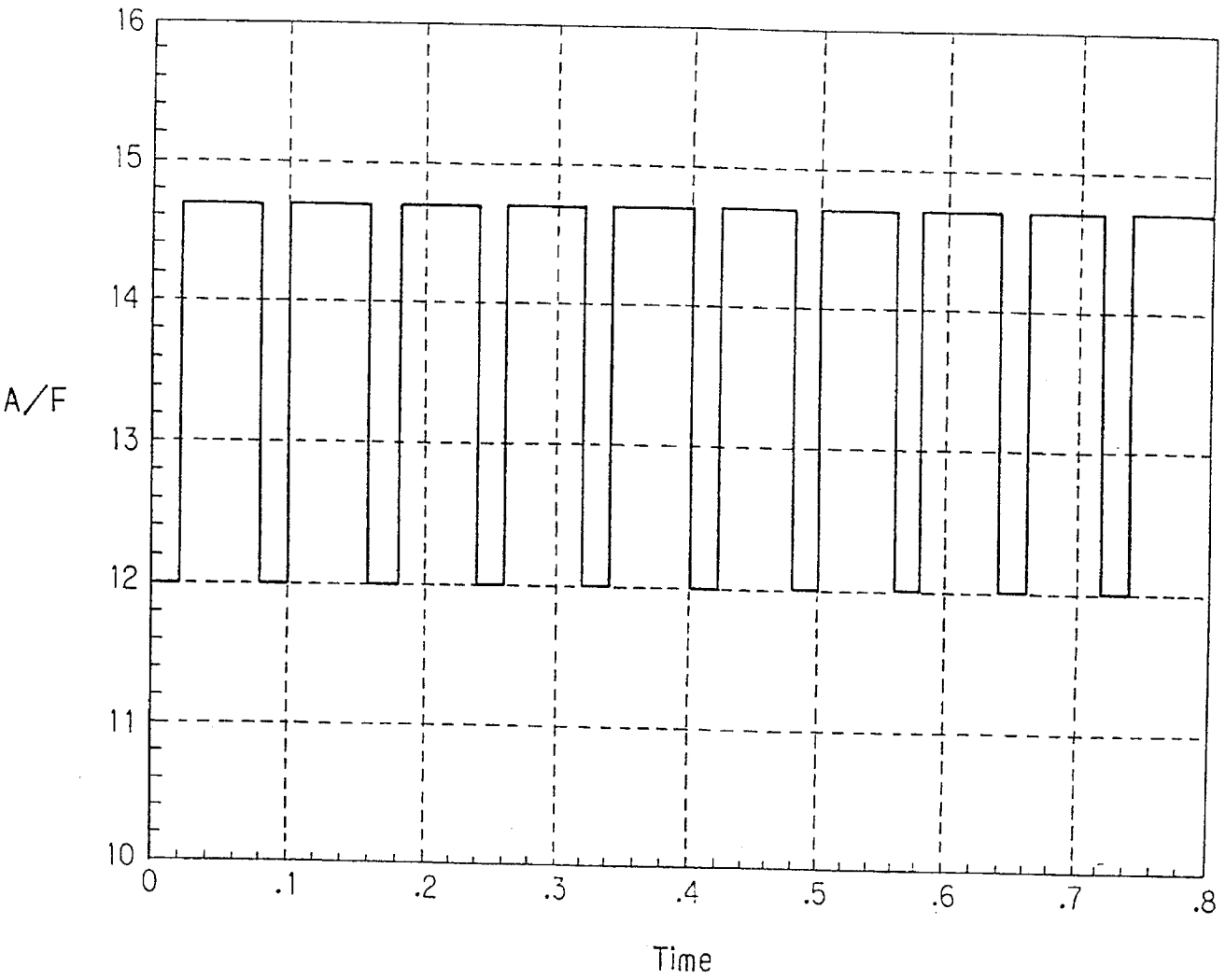
FIG. 9 is a graph of a simulation where fuel is assumed to be supplied to three cylinders of a four-cylinder engine so as to obtain an air/fuel ratio of 14.7:1, and to one cylinder so as to obtain an air/fuel ratio of 12.0:1.
Figure 10:
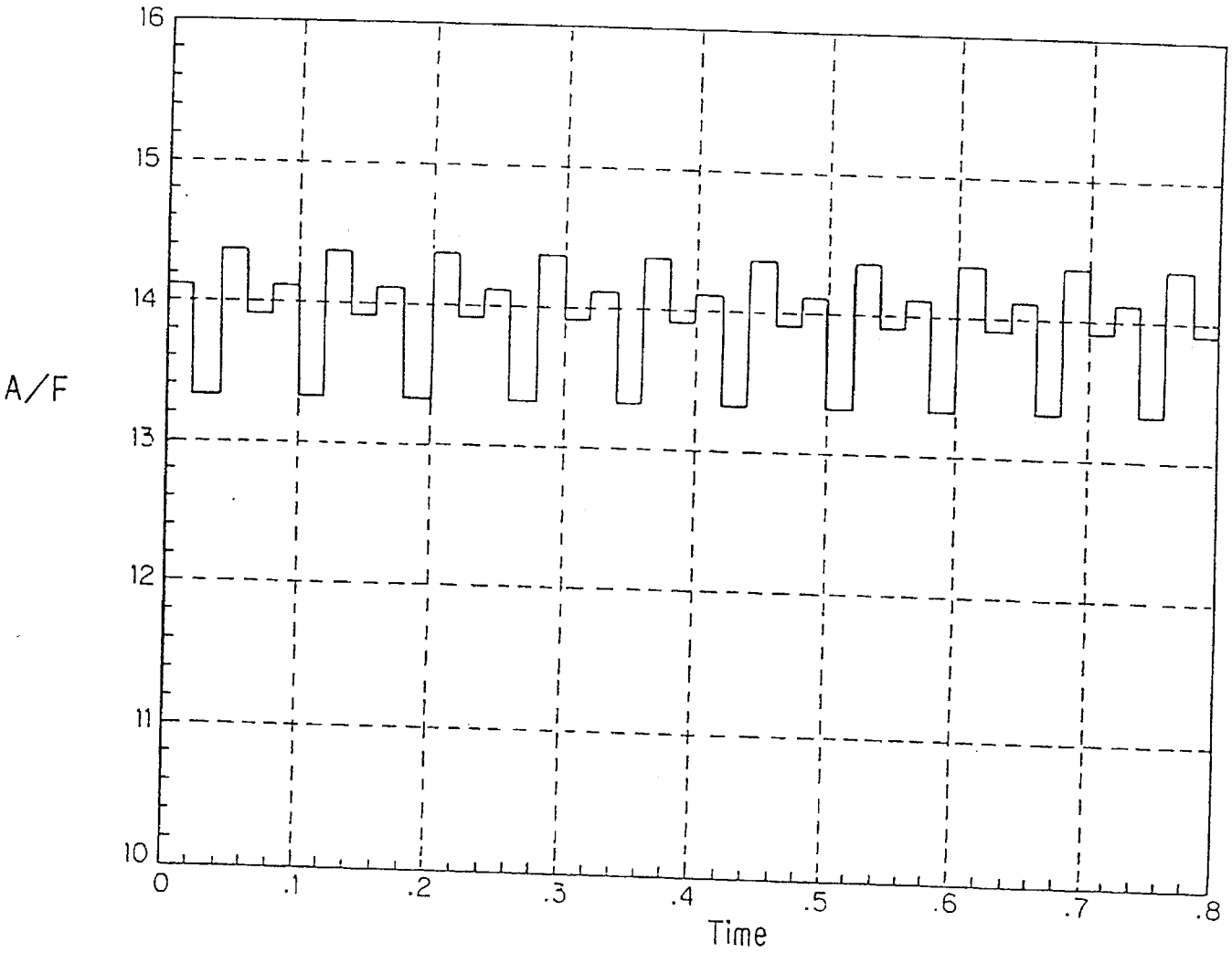
FIG. 10 is the result of the simulation which shows the output of the exhaust system model and the air/fuel ratio at a confluence point when the fuel is supplied in the manner illustrated in FIG. 9.
Figure 11:
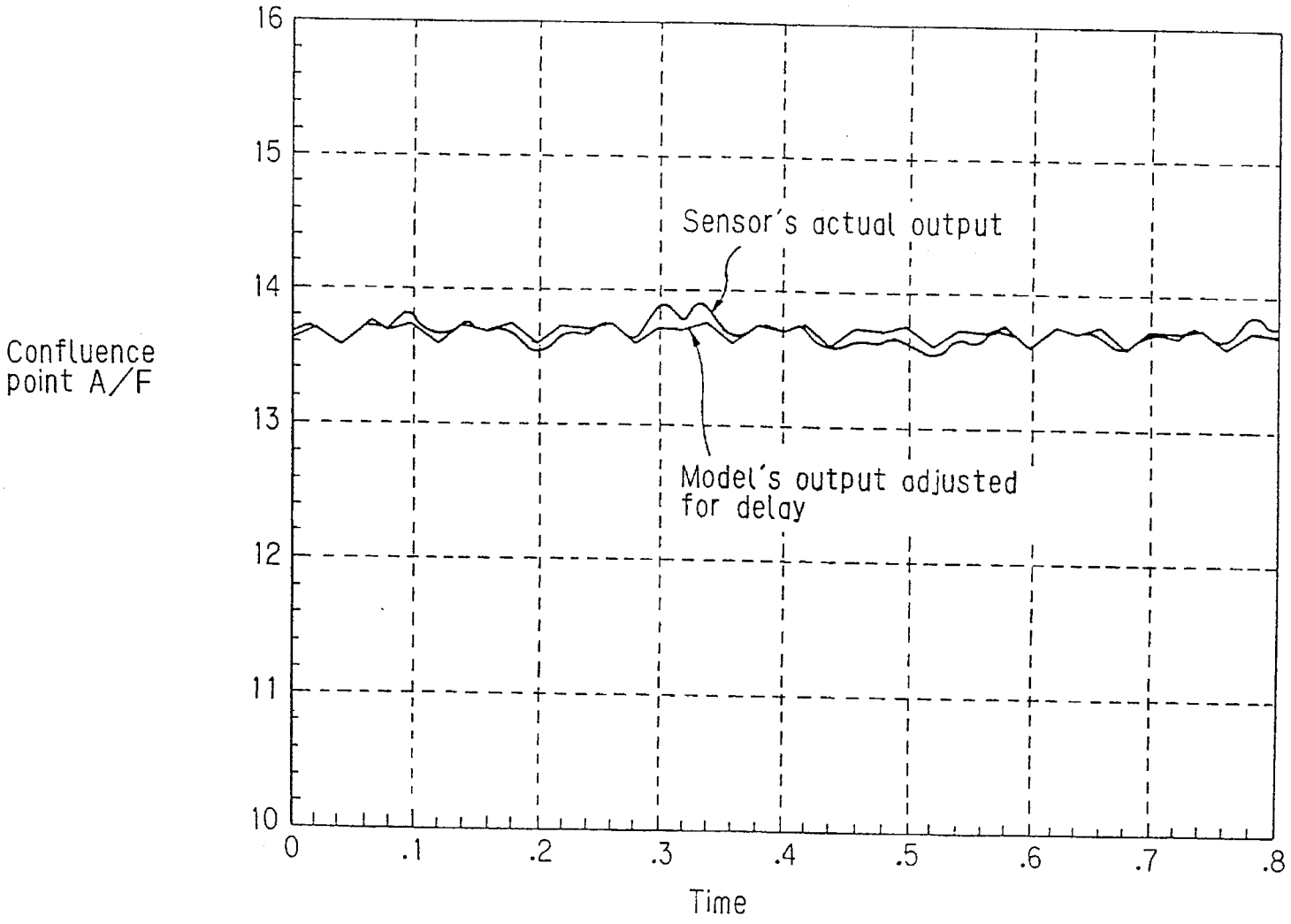
FIG. 11 is the result of the simulation which shows the output of the exhaust system model adjusted for sensor detection response delay (time lag) in contrast with the sensor's actual output.

The simulation results for the model obtained in the foregoing manner will now be given. FIG. 9 relates to the case where fuel is supplied to three cylinders of a four-cylinder internal combustion engine so as to obtain an air/fuel ratio of 14.7:1, and to one cylinder so as to obtain an air/fuel ratio of 12.0:1. FIG. 10 shows the air/fuel ratio at this time at the confluence point as obtained using the aforesaid model. While FIG. 10 shows that a stepped output is obtained, when the response delay (lag time) of the LAF sensor is taken into account, the sensor output becomes the smoothed wave designated "Model's output adjusted for delay" in FIG. 11. The curve marked "Sensor's actual output" is based on the actually observed output of the LAF sensor under the same conditions. The close agreement of the model results with this verifies the validity of the model as a model of the exhaust system of a multiple cylinder internal combustion engine.

Thus, the problem comes down to one of an ordinary Kalman filter in which x(k) is observed in the state equation, Equation 10, and the output equation. When the weighted matrices Q, R are determined as in Equation 11 and the Riccati's equation is solved, the gain matrix K becomes as shown in Equation 12:

$$\begin{cases} X(k+1) = AX(k) + Bu(k) \\ y(k) = CX(k) + Du(k) \end{cases} \tag{10}$$

Here:

$$A = \begin{pmatrix} 0100 \\ 0010 \\ 0001 \\ 1000 \end{pmatrix} \quad C = [c_1 c_2 c_3 c_4] \quad B = D = [0]$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} \quad R = [1] \tag{11}$$

$$K = \begin{pmatrix} 0.0436 \\ 0.2822 \\ 1.8283 \\ -0.2822 \end{pmatrix} \tag{12}$$

Obtaining $A - KC$ from this gives Equation 13:

$$A - KC = \begin{pmatrix} -0.0022 & 0.9935 & -0.0131 & -0.0218 \\ -0.0141 & -0.0423 & 0.9153 & -0.1411 \\ -0.0914 & -0.2742 & -0.5485 & 0.0585 \\ 0.0141 & 0.0423 & 0.0847 & 0.1411 \end{pmatrix} \tag{13}$$

Figure 12:
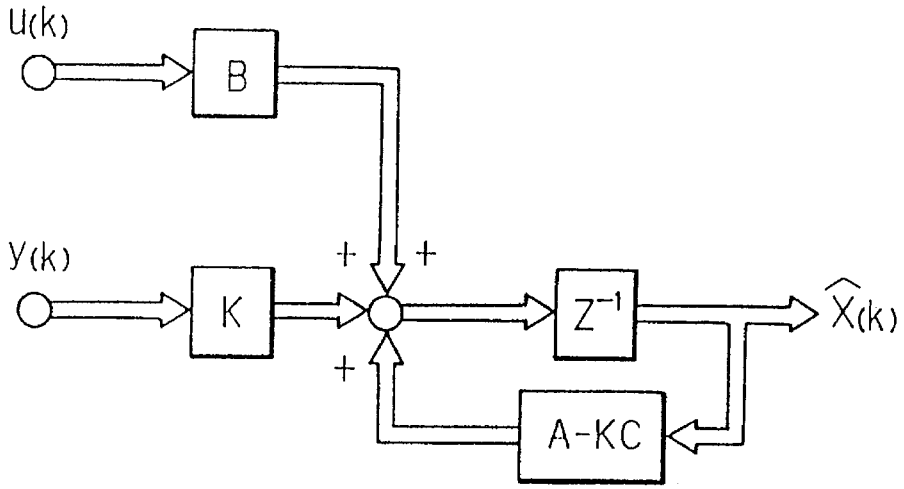
FIG. 12 is a block diagram which shows the configuration of an ordinary observer.
Figure 13:
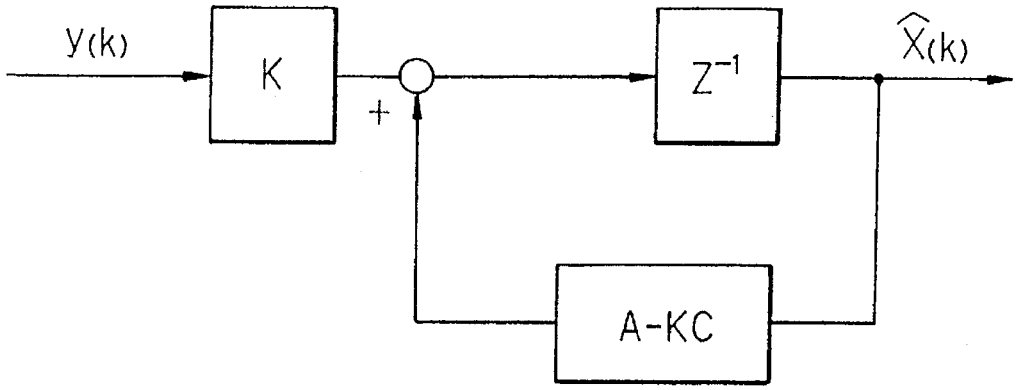
FIG. 13 PRIOR ART
FIG. 13 is a block diagram which shows the configuration of the observer referred to in the assignee's earlier application.

FIG. 12 shows the configuration of an ordinary observer. Since there is no input u(k) in the present model, however, the configuration has only y(k) as an input, as shown in FIG. 13. This is expressed mathematically by Equation 14:

$$\begin{cases} \hat{X}(k+1) = [A - KC]\hat{X}(k) + Ky(k) \\ \hat{x}(k) = [0001]\,\hat{X}(k) \end{cases} \tag{14}$$

The system matrix of the observer whose input is y(k), namely of the Kalman filter, is:

$$S = \left(\begin{array}{c|c} A - KC & K \\ \hline 0001 & 0 \end{array}\right) \tag{15}$$

In the present model, when the ratio of the member of the weighted matrix R in Riccati's equation to the member of Q is 1:1, the system matrix S of the Kalman filter is given as:

$$S=\begin{pmatrix} -0.0022 & 0.9935 & -0.0131 & -0.0218 & 0.0436 \\ -0.0141 & -0.0423 & 0.9153 & -0.1411 & 0.2822 \\ -0.0914 & -0.2742 & -0.5485 & 0.0858 & 1.8283 \\ 1.0141 & 0.0423 & 0.0847 & 0.1411 & -0.2822 \\ 0.0000 & 0.0000 & 0.0000 & 1.0000 & 0.0000 \end{pmatrix} \quad (16)$$

Figure 14:
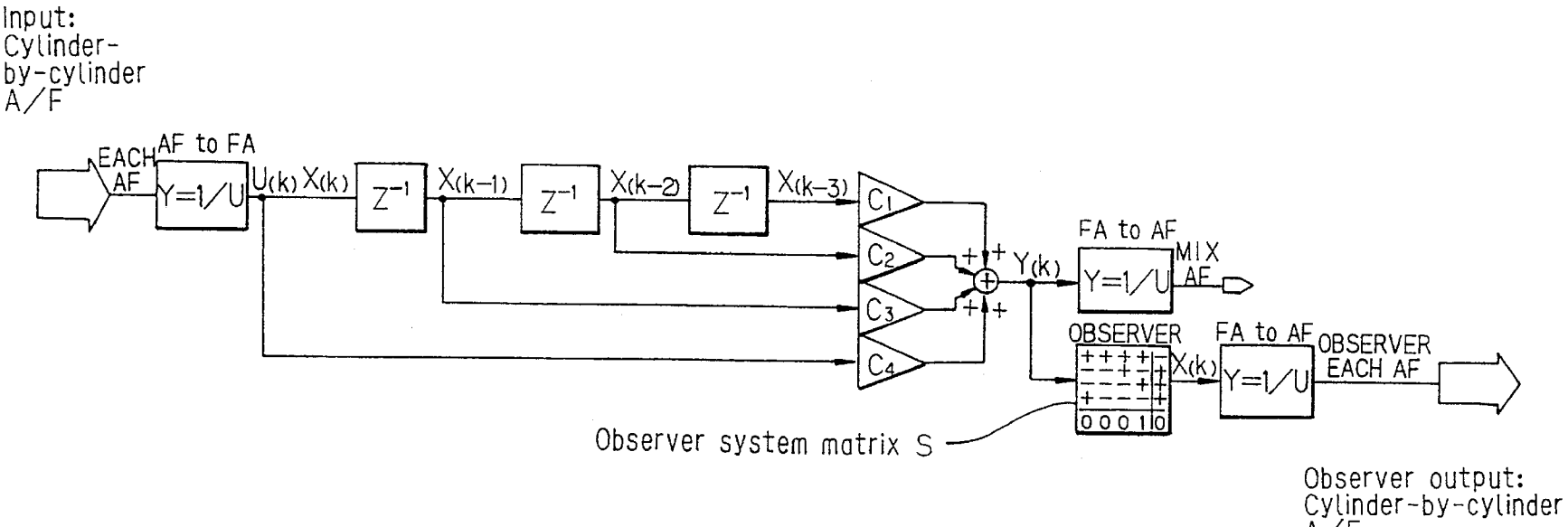
FIG. 14 PRIOR ART
FIG. 14 is an explanatory block diagram which shows the configuration achieved by combining the model of FIG. 8 and the observer of FIG. 13.

FIG. 14 shows the configuration in which the aforesaid model and observer are combined. As this was described in detail in the assignee's earlier application, no further explanation will be given here.

Thus, the system according to the invention has a mathematical model describing the behavior of said exhaust system based on said outputs of said air/fuel ratio sensor, having an observer observing an internal state of the mathematical model and calculating an output which estimates an air/fuel ratio in each cylinder of said engine, and the air/fuel ratio of each cylinder is determined based on said output of said observer.

More specifically, the mathematical model has exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices assuming means for assuming said input U(k) as a predetermined value to establish an observer expressed by an equation using said output Y(k) as an input in which a state variable X indicates said air/fuel ratio in each individual cylinder as $$\hat{X}(k+1)=[A-KC]\hat{X}(k)+KY(k)$$

where K is a gain matrix and estimating means for estimating said air/fuel ratio in each cylinder from said state variable $\hat{X}$. The air/fuel ratio of each cylinder is determined based on the estimated air/fuel ratio.

Figure 15:
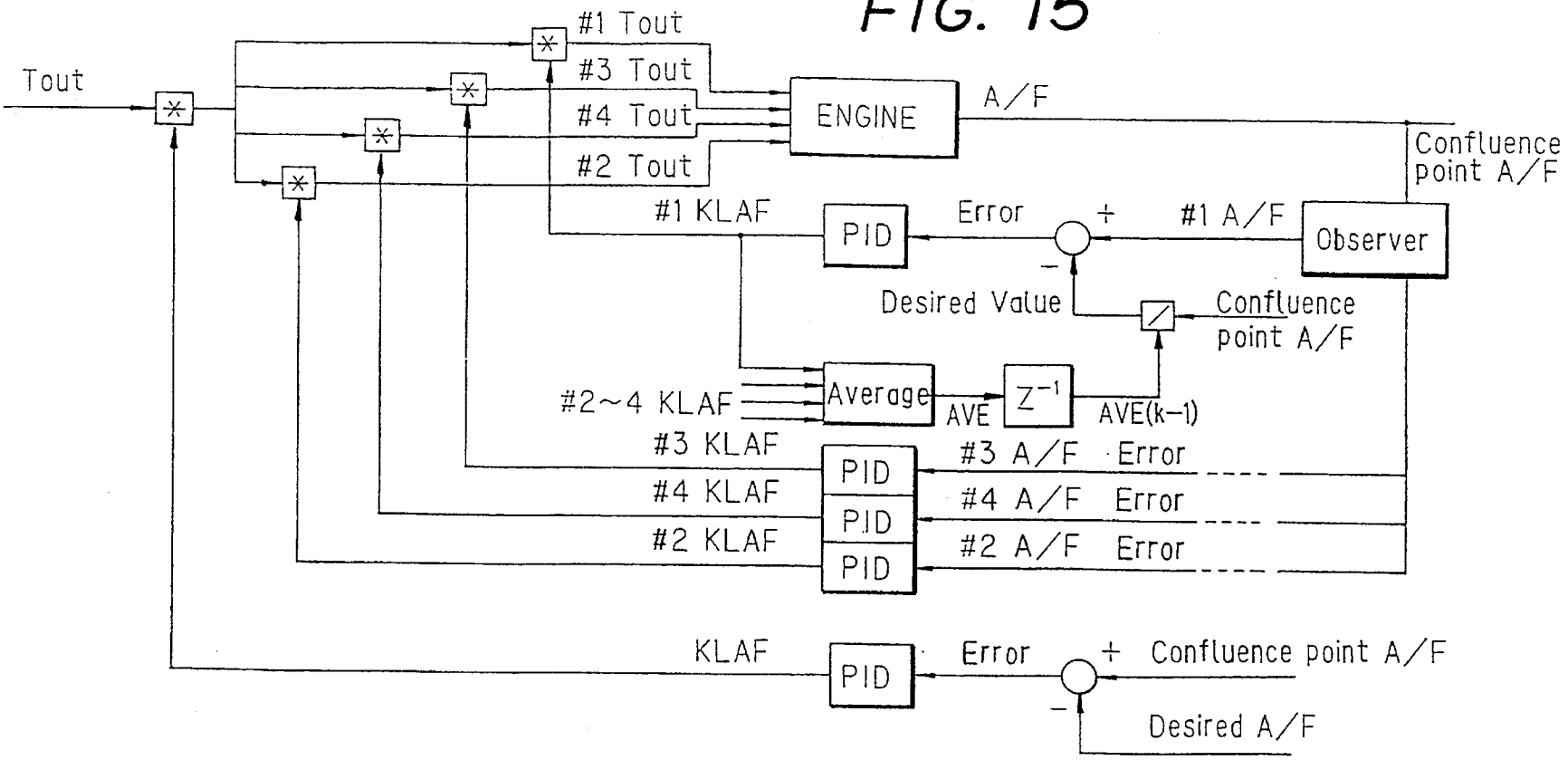
FIG. 15 is a block diagram showing the overall configuration of an air/fuel ratio feedback control based on the air/fuel ratio obtained by the system according to the invention.

Since the observer is able to estimate the cylinder-by-cylinder air/fuel ratio (each cylinder's air/fuel ratio) from the air/fuel ratio at the confluence point, the air/fuel ratios in the individual cylinders can, as shown in FIG. 15, be separately controlled by a PID controller or the like. Specifically, as shown in FIG. 15, only the variance between cylinders is absorbed by the cylinder-by-cylinder air/fuel ratio feedback factors (gains) #nKLAF, whereas the error from the desired air/fuel ratio is absorbed by the confluence point air/fuel ratio feedback factor (gain) KLAF. More specifically, as disclosed, the desired value used in the confluence point air/fuel ratio feedback control is the desired air/fuel ratio, while the cylinder-by-cylinder air/fuel ratio feedback control arrives at its desired value by dividing the confluence point air/fuel ratio by the average value AVEk−1, from the average value AVE of the cylinder-by-cylinder feedback factors #nKLAF of all the cylinders of the preceding cycle.

With this arrangement, the cylinder-by-cylinder feedback factors #nKLAF operate to converge the cylinder-by-cylinder air/fuel ratios to the confluence point air/fuel ratio and, moreover, since the average value AVE of the cylinder-by-cylinder feedback factors tends to converge to 1.0, the factors do not diverge and the variance between cylinders is absorbed as a result. On the other hand, since the confluence point air/fuel ratio converges to the desired air/fuel ratio, the air/fuel ratios of all cylinders should therefore converge to the desired air/fuel ratio.

The fuel injection quantity #nTout here can be calculated in terms of the opening period of the fuel injector 20 as;

$$\#nTout=Tim\times KCMD\times KTOTAL\times\#nKLAF\times KLAF$$

where Tim: base value, KCMD: desired air/fuel ratio determined from parameters at least including that obtained by the $O_2$ sensors 34*a*, 34*b* (expressed as the equivalence ratio to be multiplied by the base value), KTOTAL: other correction factors. While an addition factor for battery correction and other addition factors might also be involved, they are omitted here. As this control is described in detail in the assignee's earlier Japanese Patent Application No. Hei 5(1993)-251,138 (filed in the United States on Sep. 13, 1994 under the number of Ser. No. 08/305,162), it will not be described further here.

Here, the above mentioned observer estimation will be explained with respect to the V-type six-cylinder engine 10 used in the embodiment.

In the engine disclosed, it is necessary to design the observer for each three-cylinder bank 23*a* or 23*b* respectively. In other words, this is equivalent to the situation that each observer estimates the air/fuel ratios of an in-line three-cylinder engine. In that case, the number of weighting coefficients C that indicate the past firing histories of the respective cylinders is decreased to three, i.e., C1–C3. The state equation mentioned in Equation 7 will therefore be rewritten as Equation 17.

$$\begin{pmatrix} x(k-1) \\ x(k) \end{pmatrix}=\begin{pmatrix} 01 \\ 00 \end{pmatrix}\begin{pmatrix} x(k-2) \\ x(k-1) \end{pmatrix}+\begin{pmatrix} 0 \\ 1 \end{pmatrix}u(k) \quad (17)$$

And if the air/fuel ratio at the confluence point is defined as y(k), the output equation in Equation 8 will be rewritten as Equation 18.

$$y(k)=[c_1\ c_2]\begin{pmatrix} x(k-2) \\ x(k-1) \end{pmatrix}+c_3u(k) \quad (18)$$

Here:

$c_1$:0.15, $c_2$:0.35, $c_3$:0.50

Since u(k) is also unobservable, it is not possible to observe x(k) if an observer is designed from this equation. Therefore, assuming that no abrupt change occurs in the air/fuel ratio of each cylinder from that of the same cylinder of one cycle (i.e., 6 TDCs in the six-cylinder engine) earlier and defining x(k+1)=x(k−2), Equation 9 will be rewritten as Equation 19.

$$\begin{pmatrix} x(k-1) \\ x(k) \\ x(k+1) \end{pmatrix}=\begin{pmatrix} 010 \\ 001 \\ 100 \end{pmatrix}\begin{pmatrix} x(k-2) \\ x(k-1) \\ x(k) \end{pmatrix} \quad (19)$$

$$y(k)=[c_1\ c_2\ c_3]\begin{pmatrix} x(k-2) \\ x(k-1) \\ x(k) \end{pmatrix}$$

Equations 10–14 mentioned before will therefore be rewritten as similar equations of third order or the system matrix of the Kalman filter shown in Equations 15 and 16 will similarly be given.

Figure 16:
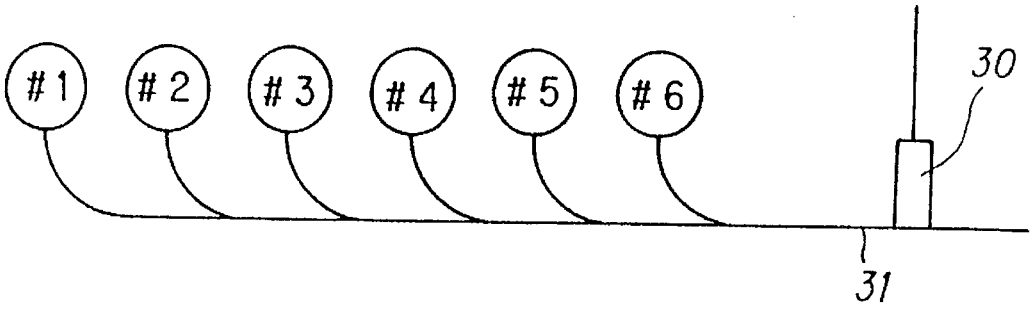
FIGS. 16 to 20 are explanatory views showing in-line engines having various shapes of exhaust manifolds each having an air/fuel ratio sensor installed at a confluence point of the exhaust manifold.
Figure 17:
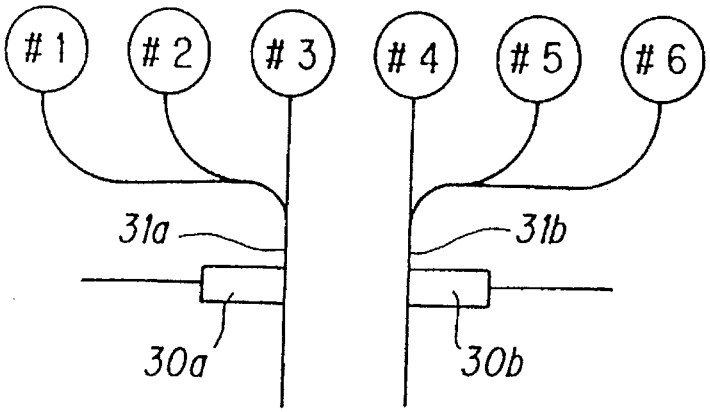

In the air/fuel ratio estimation through the observer, thus, the order of the state equation and the output equation is determined in accordance with the number of engine cylinders whose air/fuel ratio are to be estimated. For example, when the engine is an in-line six-cylinder engine having the shape of "6-1 confluent" (i.e., six exhaust pipes are combined into one) and a single LAF sensor 30 is installed at the confluent point 31 as is illustrated in FIG. 16, the equations will be of sixth order. As illustrated in FIG. 17, when the engine is an in-line six-cylinder having the shape of "6-2-1 confluent" and two LAF sensors 30*a*, 30*b* are respectively installed at the "2" confluent points 31*a*, 31*b*, the equations will be of third order just like the V-type six-cylinder engine shown in FIG. 1.

Figure 18:
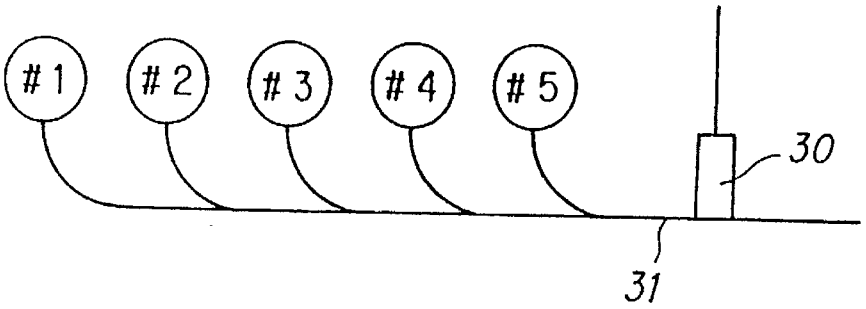
Figure 19:
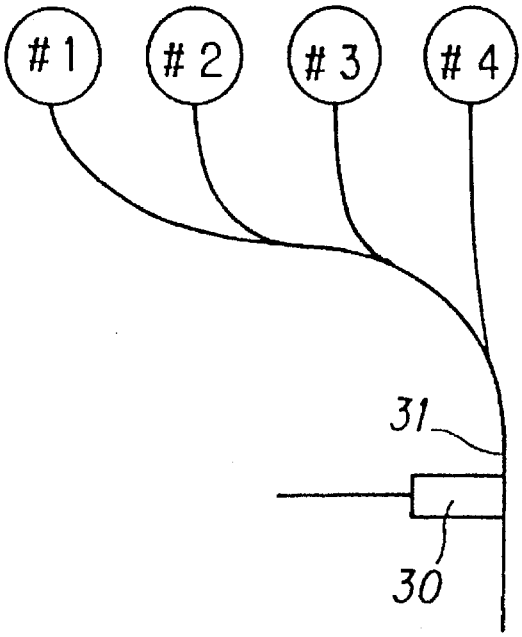
Figure 20:
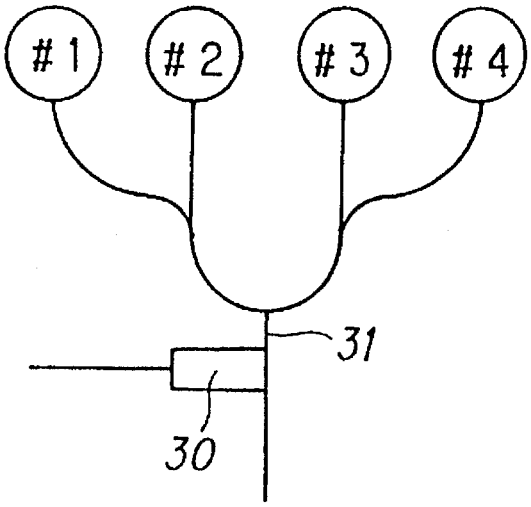

Similarly, the in-line five-cylinder engine having the shape of "5-1 confluent" shown in FIG. 18 will have the equations of fifth order. Moreover, the in-line four-cylinder engines having the shape of "4-1 confluent" shown in FIG. 19 or that having the shape of "4-2-1 confluent" engine illustrated in FIG. 20 both provided with a single LAF sensor 30 at the "1" confluent point 31 will have the equations of fourth order, since the number of cylinders whose air/fuel ratios are to be estimated is four.

It will be apparent from the foregoing that the observer can readily be designed when it is assumed that no abrupt change occurs between the air/fuel ratio in each cylinder and that of the same cylinder of one cycle earlier.

Based on the foregoing, the operation of the air/fuel ratio detection system according to the invention will now be explained with reference to the flowchart of FIG. 4. The program shown is activated periodically at a crank angular period designated as "calculation" in FIG. 3.

The program begins at step S10 in which the engine speed Ne and the manifold absolute pressure Pb are read, and proceeds to step S12 in which it is checked whether the value of a counter CYL-COUNT for counting the number of the six cylinders consecutively is zero. Here, the firing (combustion) order of the six cylinders are predetermined as #1, #4, #2, #5, #3 and #6 and the counter values 0 to 4 are designed to correspond to the firing order. Namely:

| Counter value | Cylinder |
|---|---|
| 0 | #1 |
| 1 | #4 |
| 2 | #2 |
| 3 | #5 |
| 4 | #3 |

Accordingly, when the result in step S12 is affirmative, it is discriminated that the cylinder just fired and burned is #1, more precisely, that it is at the "calculation" period of #1 cylinder, and the program passes to step S14 in which the timing map for #1 cylinder is retrieved using .the engine speed Ne and the manifold absolute pressure PB as address data to select one from among the sampled data stored in the 12 calculation buffers by buffer number (No. 0–11).

Figure 21:
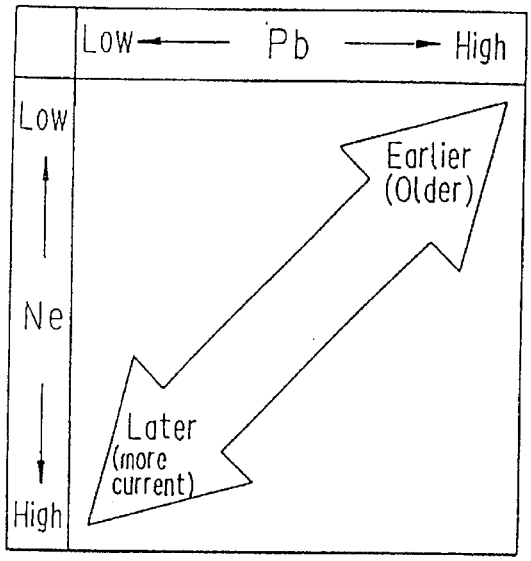
FIG. 21 is an explanatory view showing the characteristics of a timing map referred to in the flowchart of FIG. 4.

FIG. 21 shows the characteristics of the timing map. As illustrated, it is arranged such that the datum sampled at an earlier crank angular position is selected as the engine speed Ne decreases or as the manifold absolute pressure (engine load) Pb increases. Here, "the datum sampled at earlier crank angular position" means the datum sampled at a crank angular position closer to the last TDC crank position. Conversely speaking, the timing map is arranged such that, as the engine speed Ne increases or the manifold absolute pressure Pb decreases, the datum sampled at a later crank angular position, i.e., at a later crank angular position closer to the current TDC crank position, i.e., more current sampled datum should be selected at that instance.

Figure 22:
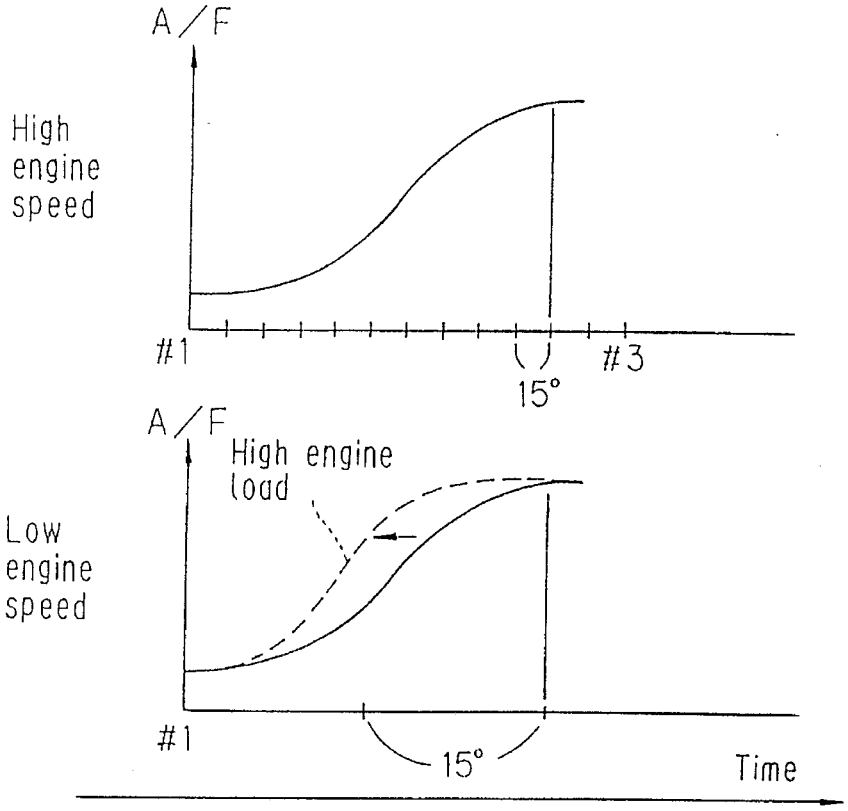
FIG. 22 is a timing chart showing the characteristics of sensor output with respect to the engine speed and load.
Figure 27:
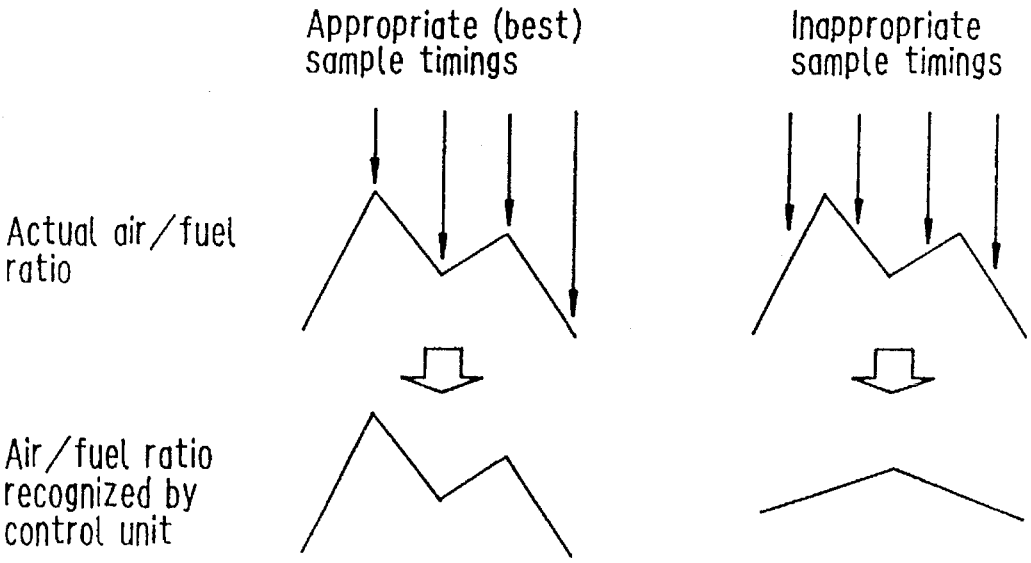
FIG. 27 is an explanatory view showing appropriate (best) sample timings of air/fuel ratio sensor outputs in contrast with inappropriate sample timings.

That is, it is best to sample the LAF sensor outputs at a position closest to the turning point of the actual air/fuel ratio as mentioned before with reference to FIG. 27. The turning point such as the first peak occurs at an earlier crank angular position as the engine speed lowers, as illustrated in FIG. 22, provided that the sensor's reaction time is constant. Moreover, it is considered that the pressure and volume of the exhaust gas increases as the engine load increases, and therefore the exhaust gas flow rate increases and hence the arrival time at the sensor becomes earlier. Based on the foregoing, the characteristics of the sample timing are set as illustrated in FIG. 21.

In addition, in the engine disclosed in FIG. 1, the distances from the cylinder exhaust ports to the LAF sensors are not uniform for all the cylinders and are different for each cylinder. In the figure, the distance from #1 or #4 cylinder to the LAF sensor is greater than that of #2 or #5 cylinder, and the distance from #2 or #5 cylinder to the LAF sensor is greater than that of #3 or #6 cylinder. Accordingly, the arrival time of the exhaust gas varies according to the distances provided that the engine operating conditions remain unchanged.

More specifically, assume that the LAF sensor output at a turning point (breaking point) is the datum sampled 7 times earlier (buffer No. 7) or 1 time earlier (buffer No. 1) for #2 cylinder. For #1 cylinder, the point might fall at, for example, 6 times earlier (buffer No. 6) or the current one (buffer No. 0). Namely, the exhaust gas from #1 (or #4) cylinder arrives at the LAF sensor later than that from #2 (or #5) cylinder due to its longer travel time. On the other hand, the exhaust gas from #3 (or #6) cylinder arrives at the LAF sensor earlier than that of #2 or #5) cylinder.

The invention is therefore configured such that the distances between the cylinder exhaust ports and the LAF sensors are measured in advance for the individual cylinders to determine the best datum indicative of the sensor output at a turning point with respect to the engine operating conditions. The data are prepared as mapped values, in terms of the buffer numbers, for the respective cylinders such that they are retrieved by the engine speed and the manifold absolute pressure, which are representative of the operating conditions of the engine. The mapped data provided for individual cylinders are named as the "timing map" in the specification.

The program then moves to step S16 in which the air/fuel ratio at #1 cylinder is determined or detected on the basis of the retrieved datum, more correctly on the basis of the sampled datum corresponding to the buffer number retrieved from the timing map for #1 cylinder. The program then proceeds to step S18 in which the counter CYL-COUNT is incremented. It should be noted that the counter value is initialized to zero in a step (not shown) when it has reached 5.

On the other hand, when the decision in step S12 is negative, the program proceeds to step S20 in which it is checked whether the counter value is 1 and if it is, since this means that the cylinder is #4, the program passes to step S22 in which the timing map for #4 cylinder is retrieved. If the decision in step S20 is negative, on the contrary, the program proceeds to steps S24 and on in which any of the timing maps for #2, #5 or #3 cylinders is retrieved for the cylinder concerned. At that time, if the decision in step S32 is negative, since this means that the cylinder just fired and burned is #6, the program proceeds to step S36 in which the timing map for that cylinder is retrieved. Thus, following the procedures shown in the figure, one value from among the 12 values stored in the buffers is retrieved for the cylinder concerned and the air/fuel ratio is determined or detected on the basis of the selected datum.

With the arrangement, it becomes possible to enhance the air/fuel ratio detection accuracy. More specifically, as illustrated in FIG. 3, since the sampling is conducted in a relatively short interval, the sampled values can reflect the initial sensor output faithfully. Moreover, since the data sampled at every relatively short interval are successively stored in the buffers and by anticipating a possible turning point of the sensor output by the engine speed and manifold absolute pressure (engine load) and the distances to the LAF sensor from the cylinders concerned, one value from among those stored in the buffers (presumably corresponding to that occurring at a turning point) is selected. As a result, it becomes possible to detect the air/fuel ratio accurately in the engine where distances from the cylinder exhaust ports to the sensor are different for each cylinder even when the engine speed or the manifold absolute pressure varies. In other words, the control unit is able to recognize the maximum and minimum values in the sensor output correctly.

This will be explained with reference to FIG. 23, taking again a four-cylinder engine as an example.

When the distances to the LAF sensor are uniform for the all cylinders in the engine, the exhaust gas from each cylinder travels over the same distance and becomes maximum in volume periodically as illustrated in the left of the figure. If the confluence point air/fuel ratio is detected, for example, at point ① (time k for exhaust TDC of #2 cylinder), the contribution of the exhaust gas of #2 cylinder just burned to the confluence point air/fuel ratio will be greatest as expected in the weighting coefficients C of the output equation shown in Equation 8 and the model shown in FIG. 8.

Figure 23:
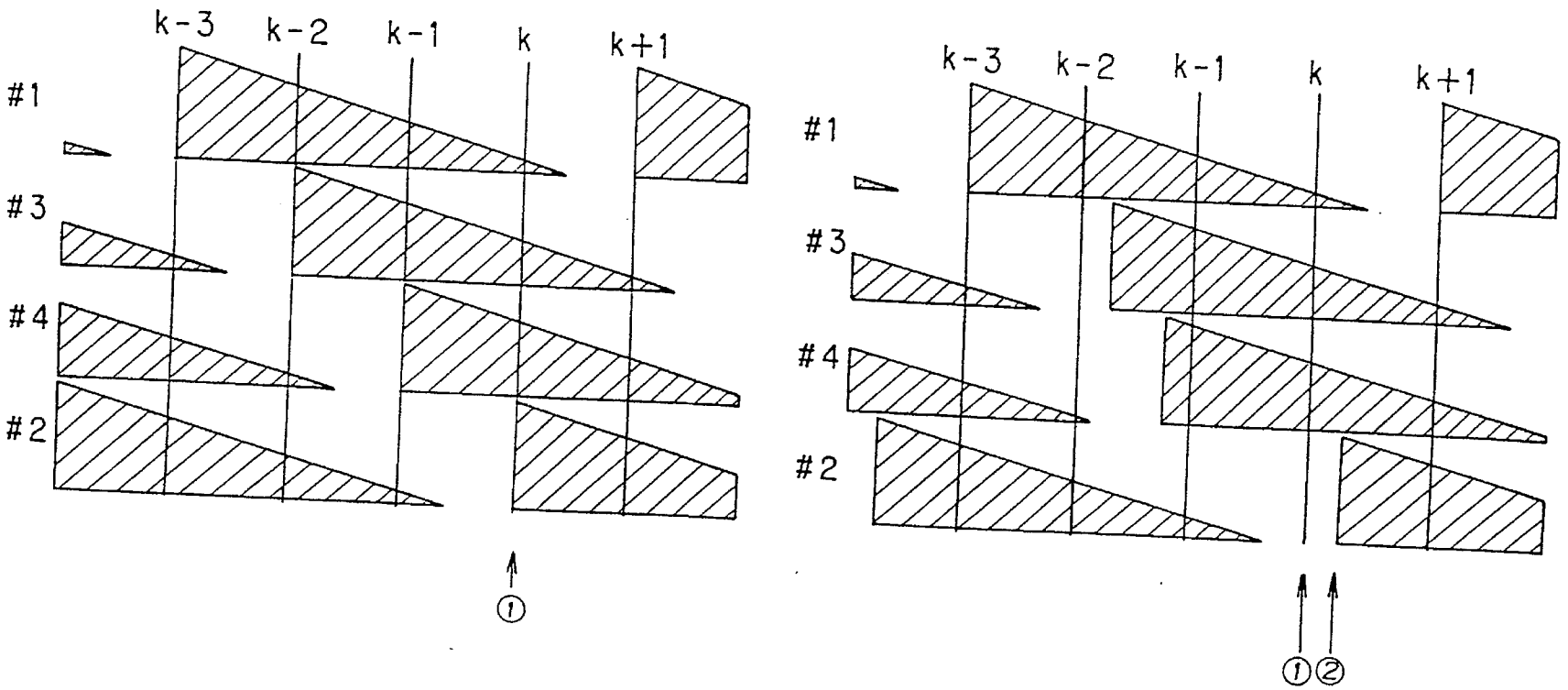
FIG. 23 is an explanatory view showing the characteristic feature of the system according to the invention.

When the distances to the LAF sensor are different for the cylinders, however, the exhaust gas from some cylinder travels over a longer distance and that from another cylinder travels over shorter distance. As a result, the intervals between points at which the exhaust gases from the individual cylinders become maximum in volume are irregular, as illustrated in the right of FIG. 23. The air/fuel ratio detected at point ① does not reflect the exhaust gas from #2 cylinder just burned. This is different from the condition on which the equation or the model is based.

However, by detecting the air/fuel ratio at point ② and by deeming the detected value as the air/fuel ratio at the time k (point ①), it becomes possible to compensate for the interval irregularity. The output equation will be applicable to the situation and based on the output, the observer can be designed to estimate the air/fuel ratios at the individual cylinders with accuracy.

It would be possible to change the sample timings themselves in response to the operating conditions of the engine. However, with the arrangement, it can be said that the invention is equivalent to changing the sample timings themselves in response to the operating conditions of the engine. In other words, the invention has the same advantages obtained in the aforesaid prior art system (1(1989)-313,644), and can solve the disadvantage of this prior art system that the turning point has already expired, i.e., the turning point was behind when the detection point is detected. Further, the invention is advantageously simple in configuration.

With the arrangement, when estimating the air/fuel ratios at the individual cylinders through the observer, it becomes possible to use the air/fuel ratio which approximates the actual behavior of the air/fuel ratio at the exhaust confluence point, enhancing the accuracy in observer estimation and hence improving the accuracy in air/fuel ratio feedback control illustrated in FIG. 15.

Figure 24:
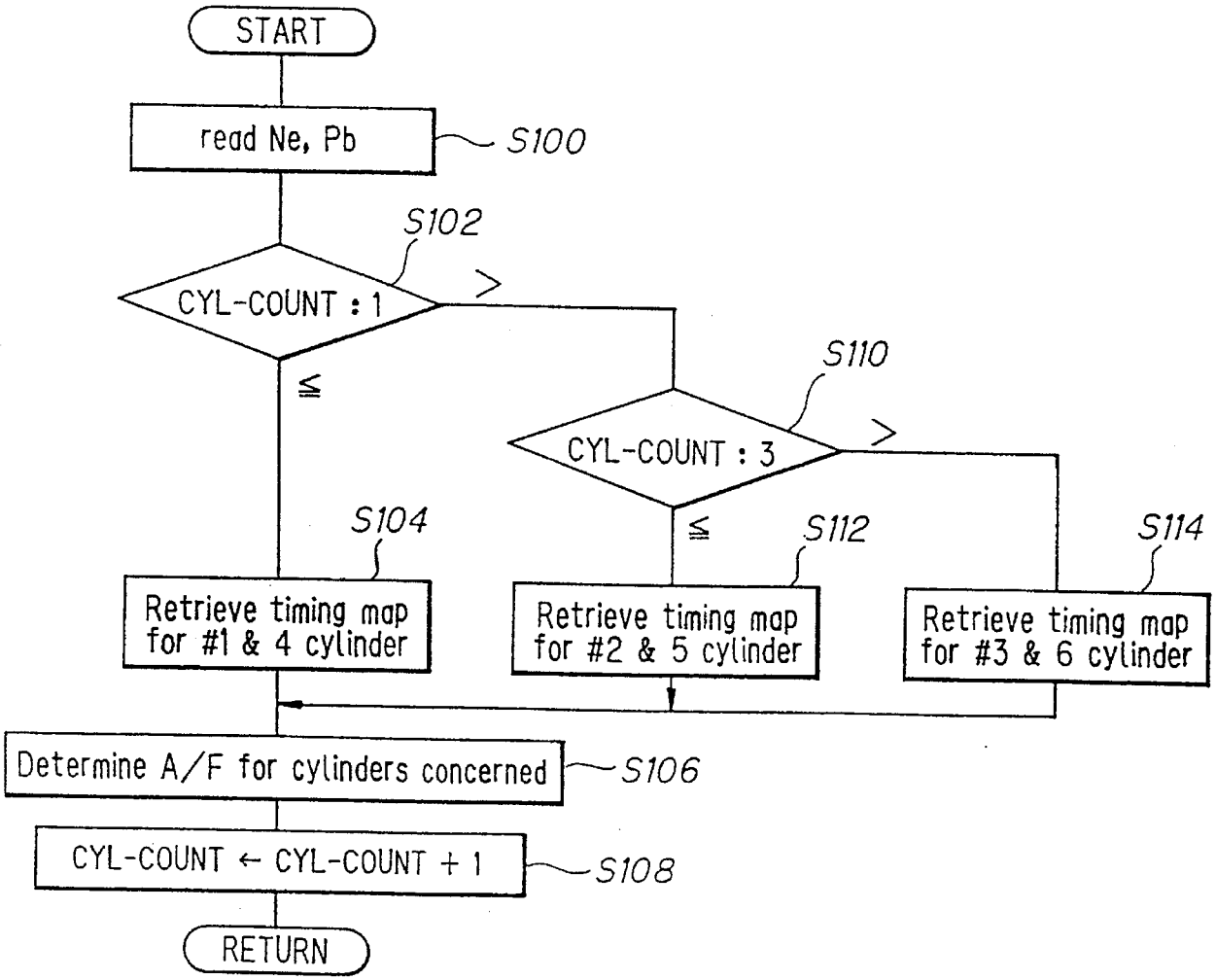
FIG. 24 is a flowchart, similar to FIG. 4, but showing a second embodiment of the invention.

FIG. 24 is a flowchart similar to FIG. 4, but shows a second embodiment of the invention.

The second embodiment will be explained with reference to the flowchart focussing on the difference from the first embodiment.

In the second embodiment, only three timing maps are prepared. That is, in the engine shown in FIG. 1, since the distance to the LAF sensor of #1 cylinder in the first bank 23*a* is almost equal to that of #4 cylinder in the second bank 23*b*, and similarly the distances of #2 and #3 cylinders in the first bank 23*a* are almost the same as those of #5 and #6 cylinders in the second bank 23*b*, timing maps are therefore prepared in advance for the respective associated cylinders in the two banks 23*a*, 23*b*.

Specifically, the program starts at step S100 in which the engine speed Ne, etc. are read, and proceeds to step S102 in which it is checked whether the counter value is not more than 1; and if it is, to step S104 in which the timing map for #1 and #4 cylinders is retrieved according to the read engine operating parameters Ne and Pb. Here, it is predetermined that the cylinder just fired and burned is either #1 or #4 when the counter value is not more than 1. More specifically, only one timing map is provided for #1 and #4 cylinders and when the counter value is not more than 1, the timing map for #1 and #4 cylinders is retrieved. The program then proceeds to step S106 in which the air/fuel ratios of #1 and #4 cylinders are determined or detected from the retrieved value and to step S108 in which the counter value is incremented.

On the other hand, when step S102 finds that the counter value is greater than 1, the program goes to step S110 in which it is checked whether the counter value is not more than 3 and if it is, it is judged that the cylinder just fired and burned is either #2 or #5, and to step S112 in which the timing map for #2 and #5 cylinders is retrieved, to step S106 in which the air/fuel ratio is determined for #2 and #5 cylinders. If step S110 finds that the counter value is greater than 3, it is judged that the cylinder just fired and burned is #3 or #6 so that the program moves to step S114 in which the third timing map for #3 and #6 cylinders is retrieved, and then to step S106 in which the air/fuel ratio is determined for #3 and #6 cylinders.

With the arrangement, the second embodiment can select one from among the sampled data which approximates the actual behavior of the air/fuel ratio at the exhaust confluence point in response to the operating conditions of the engine even when the cylinders are positioned with different distances to the LAF sensor and can detect the air/fuel ratio for the respective cylinders optimally. Moreover, since the number of the timing maps is decreased from six to three, the configuration is made simpler.

Figure 25:
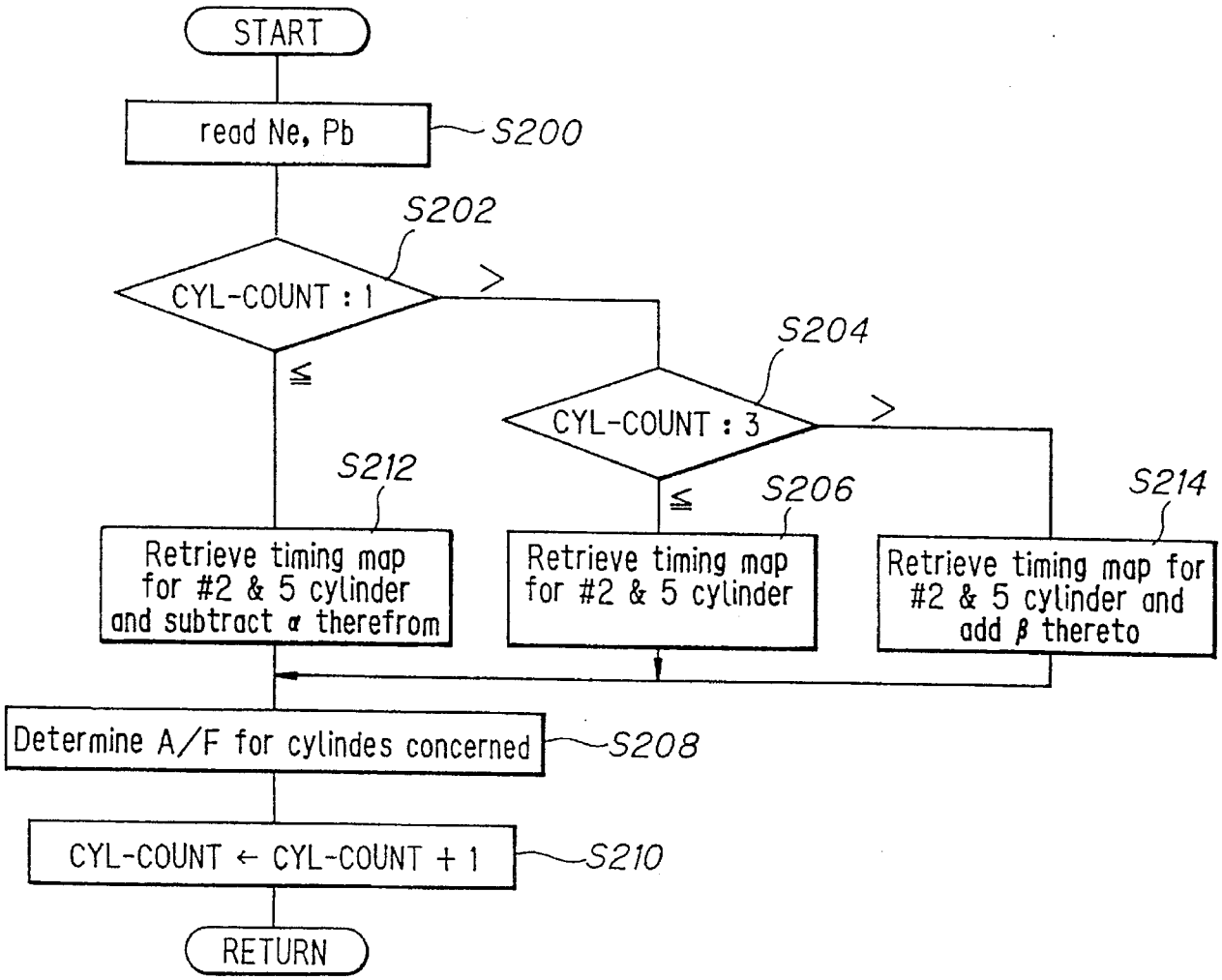
FIG. 25 is a flowchart, similar to FIG. 4, but showing a third embodiment of the invention.
Figure 26:
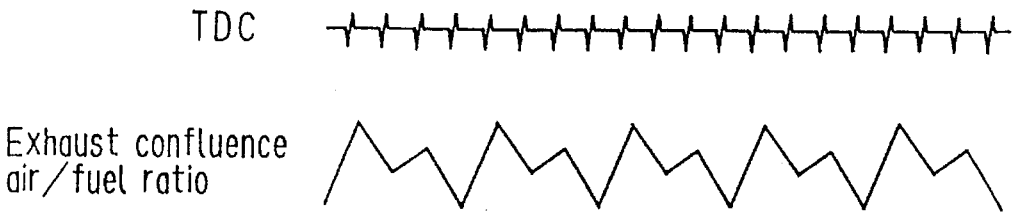
FIG. 26 is an explanatory view showing the relationship between the air/fuel ratio at the confluence point of the exhaust system of an engine relative to the TDC crank position.

FIG. 25 is a flowchart similar to FIG. 4, but shows a third embodiment of the invention.

As illustrated, the configuration is further made simpler. In the third embodiment only one timing map is prepared in advance for #2 and #5 cylinders each positioned in the middle of the three cylinders in each of the banks. For the other cylinders, the datum retrieved from the single timing map is subtracted (reduced) or added (increased) to determine a pseudo-retrieved datum for sample data selection.

In the flowchart, the program begins at step S200 in which the engine speed Ne, etc. are read, and proceeds to step S202 in which it is checked whether the counter value is more than 1. If it is not, the program moves to step S204 in which it is again checked whether the counter value is not more than 3. If the result is affirmative, it is judged that the cylinder just fired and burned is either #2 or #5 and the program advances to step S206 in which the timing map for #2 and #5 cylinders is retrieved, and to step S208 in which the air/fuel ratio is determined for #2 and #5 cylinders, and then to step S210 in which the counter value is incremented.

In the case that step S202 finds that the counter value is not more than 1, it is judged that the cylinder just fired and burned is either #1 or #4, and the program proceeds to step S212 in which the aforesaid timing map for #2 and #5 cylinders is retrieved. Then the retrieved value is reduced by a value α and the program moves to step S208 in which the air/fuel ratio of #1 and #4 cylinders is determined on the basis of the difference. This is because, the distance of #1 or #4 cylinder to the LAF sensor 30 is greater than that of #2 or #5 cylinder in the configuration of FIG. 1 so that it takes more time for the gas exhausted from #1 or #4 cylinder to arrive at the sensor than that from #2 or #5 cylinder. This means that the datum to be selected should be a value sampled later than that for #2 or #5 cylinder. Stating this with reference to FIG. 3, the datum to be selected is a righthanded one, i.e., one that is obtained by subtraction.

In the third embodiment, therefore, the difference in the exhaust gas arrival times to the LAF sensor between #1(4) cylinder and #2(5) cylinder is measured in response to the operating conditions of the engine to determine the aforesaid value α for subtraction corresponding thereto. Since the arrival time varies with the operating conditions of the engine such as the engine speed, the intake manifold absolute pressure, the exhaust manifold pressure, exhaust gas velocity and other similar parameters, the value α also varies with these parameters.

Returning to the flowchart, when step S204 finds that the counter value is greater than 3, it is judged that the cylinder just fired and burned is either #3 or #6, and the program proceeds to step S214 in which the #2 and #5 cylinder timing map is retrieved and the retrieved value is increased by a value β, and then to step S208 in which the air/fuel ratio for #3 and #6 cylinders is determined on the basis of the sum. Since the distance of #3 or #6 cylinder to the LAF sensor is shorter than that of #2 or #5 cylinder and hence, the arrival time is earlier, the retrieved value is added to β such that any datum sampled earlier should be selected. The value β is determined in a similar manner to that of the value α. The values α, β should not always be integer values, but may be expressed in terms of fractions. If they are expressed in terms of fractions, they can be values that are obtained by interpolating two adjacent buffer numbers.

With the arrangement, the third embodiment can select one from among the sampled data which approximates the actual behavior of the air/fuel ratio at the exhaust confluence point in response to the operating conditions of the engine even when the cylinders are positioned with different distances to the LAF sensor. Moreover, since the number of timing maps is decreased from three to one, the configuration is made the simplest.

It should be noted in the first to third embodiment that, although the embodiments have been described taking a V-type six-cylinder engine having two three-cylinder banks as an example of a multicylinder engine having distances from cylinder exhaust ports to the LAF sensor which are not equal with each other, the invention is not limited to that type of engine. The invention will be applied to any other type including an in-line four-cylinder engine if the distances from the cylinder exhaust ports to the air/fuel sensor are not common for all cylinders, or an in-line five-cylinder engine, such as taught by Japanese Patent Publication Hei 5(1993)-30,966 in which the exhaust manifold is configured to have a particular shape known as "5-2 confluent" or "5-3 confluent" in order to decrease the exhaust gas interference, so that the distances to the air/fuel ratio sensor will generally not be uniform for all cylinders.

It should also be noted that, although the detection circuit is respectively provided for processing the outputs from the LAF sensors at the individual banks, it is alternatively possible to provide only one detection circuit for processing the outputs from the LAF sensor at the two banks.

It should further be noted that, although the embodiments have been described with respect to examples in which a model describing the behavior of the exhaust system is built and air/fuel ratio detection and control is conducted using an observer which observes the internal state of the model, the air/fuel ratio detection system according to this invention is not limited to this arrangement and can instead be configured in another manner than that described herein.

It should further be noted that, although the embodiments have been described such that the air/fuel ratios are determined for respective cylinders, the invention is not limited to this arrangement and can instead be so configured that the air/fuel ratio is simply determined without referring to a specific cylinder.

It should further be noted that, although the operating conditions of the engine are detected through the engine speed and manifold absolute pressure, the invention is not limited to this arrangement. The parameter indicative of the engine load is not limited to the manifold absolute pressure, and any other parameter such as intake air mass flow, throttle opening degree, or the like is usable.

It should further be noted that although the embodiments have been explained with respect to the case of using a wide-range air/fuel ratio sensor, it is alternatively possible to use an $O_2$ sensor.

The present invention has thus been shown and described with reference to specific embodiments. However, it should be noted that the present invention is in no way limited to the details of the described arrangements but changes and modifications may be made without departing from the scope of the appended claims.

What is claimed is:

1. A system for detecting air/fuel ratio of an internal combustion engine having a plurality of cylinders by sampling outputs of an air/fuel ratio sensor installed at a confluence point of an exhaust system or downstream of the confluence point of said engine, comprising:

engine operating condition detecting means for detecting operating conditions of said engine;

sampling means for sampling said outputs of said air/fuel ratio sensor as a plurality of sampled data;

characteristics determining means for determining characteristics for datum selection with respect to said operating conditions of said engine;

selecting means for selecting one of said plurality of sampled data by retrieving said determined characteristics by said detected operating conditions of said engine; and air/fuel ratio determining means for determining said air/fuel ratio of said engine based on said selected sampled datum; wherein:

said engine is provided with an exhaust manifold which is connected to exhaust ports of said plurality of cylinders and merges to said confluence point of the exhaust system at which or downstream thereof said air/fuel ratio sensor is installed in such a manner that distance from the air/fuel ratio sensor to the exhaust port of at least one cylinder is different from that of another cylinder;

said characteristics determining means determines said characteristics for datum selection with respect to said operating conditions of said engine and said distance to said air/fuel ratio sensor; and said selecting means selects one of said plurality of sampled data by retrieving said determined characteristics by said detected operating conditions of said engine and said distance to said air/fuel ratio sensor.

2. A system according to claim 1, further including:

cylinder identification means for identifying said plurality of cylinders of said engine;

and said air/fuel ratio determining means determines said air/fuel ratio of each cylinder of said engine.

3. A system according claim 2, wherein said characteristics determining means determines said characteristics respectively for all cylinders of said engine.

4. A system according to claim 3, wherein said selecting means selects one of said plurality of samples data by retrieving said characteristics for a desired cylinder.

5. A system according claim 2, wherein said characteristics determining means determines said characteristics for at least one cylinder of said engine.

6. A system according to claim 5, wherein said engine has two cylinder banks such that pipes of said exhaust manifold connected to said exhaust ports of said plurality of cylinders are combined into two groups and merge into one in each group to form said confluence point of the exhaust system at which or downstream thereof said air/fuel ratio sensor is installed, and said characteristics determining means determines said characteristics for each cylinder pair in said two banks.

7. A system according to claim 6, wherein said selecting means selects one of said plurality of sampled data by retrieving said characteristics for one of said cylinder pairs in said two banks including a desired cylinder.

8. A system according to claim 5, wherein said engine has two cylinder banks such that pipes of said exhaust manifold connected to said exhaust ports of said plurality of cylinders are combined into two groups and merge into one in each group to form said confluence point of the exhaust system which or downstream thereof said air/fuel ratio sensor is installed, and said characteristics determining means determines said characteristics for one cylinder pair of said cylinder pairs in said two banks.

9. A system according to claim 8, wherein said selecting means selects one of said plurality of sampled data by retrieving said characteristics for said one cylinder pair to increase/decrease a retrieved value corresponding to a difference from a desired cylinder to that of said one cylinder pair.

10. A system according to claim 1, further including:

storing means for storing said plurality of sampled data in a memory; and said selecting means selects one of said plurality of sampled data stored in the memory.

11. A system according to claim 2, further including:

a mathematical model describing behavior of said exhaust system based on said outputs of said air/fuel ratio sensor;

estimating means for observing an internal state of the mathematical model and calculating an output which estimates an air/fuel ratio in each cylinder of said engine;

and said air/fuel ratio determining means determines said air/fuel ratio of each cylinder of said engine based on said output of said estimating means.

12. A system according to claim 11, further including:

exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices assuming means for assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix and said estimating means estimates said air/fuel ratio in each cylinder from said state variable $\hat{X}$;

and said air/fuel ratio determining means determines said air/fuel ratio of each cylinder of said engine based on said estimated air/fuel ratio.

13. A system according to claim 3, further including:

storing means for storing said plurality of sampled data in a memory; and said selecting means selects one of said plurality of sampled data stored in the memory.

14. A system according to claim 5, further including:

storing means for storing said plurality of sampled data in a memory; and said selecting means selects one of said plurality of sampled data stored in the memory.

15. A system according to claim 1, wherein said engine operating condition detecting means detects said operating conditions of said engine at least through engine speed and engine load.

16. A system for detecting air/fuel ratio of an internal combustion engine having a plurality of cylinders, said engine being provided with two cylinder banks such that exhaust manifold pipes each connected to exhaust ports of half of said plurality of cylinders are combined into two groups and merge into one in each group to form a confluence point of an exhaust system at which or downstream thereof an air/fuel ratio sensor is installed in such a manner that distance from the air/fuel ratio sensor to said exhaust port of at least one cylinder is different from that of another cylinder, comprising:

engine operating condition detecting means for detecting operating conditions of said engine from a plurality of parameters including engine speed and engine load;

sampling means for sampling outputs of said air/fuel ratio sensor as a plurality of sampled data;

storing means for storing said plurality of sampled data in a memory;

characteristics determining means for determining characteristics for datum selection for all cylinders in said two banks with respect to said operating conditions of said engine;

cylinder identification means for identifying said plurality of cylinders of said engine;

selecting means for selecting one of said plurality of sampled data stored in said memory by retrieving one of said determined characteristics for a desired cylinder by said detected engine speed and engine load; and air/fuel ratio determining means for determining an air/fuel ratio of said desired cylinder based on said selected sampled datum.

17. A system according to claim 16, further including:

a mathematical model describing behavior of said exhaust system based on said outputs of said air/fuel ratio sensor;

estimating means for observing an internal state of the mathematical model and calculating an output which estimates an air/fuel ratio in each cylinder of said engine;

and said air/fuel ratio determining means determines said air/fuel ratio of each cylinder of said engine based on said output of said estimating means.

18. A system according to claim 17, further including:

exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=Ax(k)+BU(k)$$

$$Y(k)=CX(k)+DU(k)$$

where A, B, C and D are coefficient matrices;

assuming means for assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix; and said estimating means estimates said air/fuel ratio in each cylinder from said state variable $\hat{X}$;

and said air/fuel determining means determines said air/fuel ratio of each cylinder of said engine based on said estimated air/fuel ratio.

19. A system for detecting air/fuel ratio of an internal combustion engine having a plurality of cylinders, said engine being provided with two cylinder banks such that exhaust manifold pipes each connected to exhaust ports of half of said plurality of cylinders are combined into two groups and merge into one in each group to form a confluence point of an exhaust system at which downstream thereof an air/fuel ratio sensor is installed in such a manner that distance from the air/fuel ratio sensor to said exhaust port of at least one cylinder is different from that of another cylinder, comprising:

engine operating condition detecting means for detecting operating conditions of said engine from a plurality of parameters including engine speed and engine load;

sampling means for sampling outputs of said air/fuel ratio sensor as a plurality of sampled data;

storing means for storing said plurality of sampled data in a memory;

characteristics determining means for determining characteristics for datum selection for cylinder pairs in said two banks with respect to said operating conditions of said engine;

cylinder identification means for identifying said plurality of cylinders of said engine;

selecting means for selecting one of said plurality of sampled data stored in said memory by retrieving one of said determined characteristics for a desired cylinder by said detected engine speed and engine load; and air/fuel ratio determining means for determining an air/fuel ratio of said desired cylinder based on said selected sampled datum.

20. A system according to claim 19, further including:

a mathematical model describing behavior of said exhaust system based on said outputs of said air/fuel ratio sensor;

estimating means for observing an internal state of the mathematical model and calculating an output which estimates an air/fuel ratio in each cylinder of said engine;

and said air/fuel ratio determining means determines said air/fuel ratio of each cylinder of said engine based on said output of said estimating means.

21. A system according to claim 20, further including:

exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming means for assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix; and said estimating means estimates said air/fuel ratio in each cylinder from said state variable $\hat{X}$;

and said air/fuel ratio determining means determines said air/fuel ratio of each cylinder of said engine based on said estimated air/fuel ratio.

22. A system for detecting air/fuel ratio of an internal combustion engine having a plurality of cylinders by sampling outputs of an air/fuel ratio sensor, said engine being provided with an exhaust manifold which is connected to exhaust ports of said plurality of cylinders and merges to a confluence point of an exhaust system at which or downstream thereof said air/fuel ratio sensor is installed, comprising:

sampling means for sampling said outputs of said air/fuel ratio sensor as a plurality of sampled data;

characteristics determining means for determining characteristics for datum selection for at least one of said plurality of cylinders in response to distance from said air/fuel ratio sensor to the exhaust port of said one cylinder, with respect to operating parameters of said engine including at least engine speed and engine load;

engine operating parameter detecting means for detecting said operating parameters of said engine;

cylinder identification means for identifying said one cylinder of said engine;

selecting means for selecting one of said plurality of sampled data in accordance with said determined characteristics by said detected operating parameters of said engine; and air/fuel ratio determining means for determining said air/fuel ratio of said engine based on said selected sampled datum.

23. A system according to claim 22, further including:

storing means for storing said plurality of sampled data in a memory; and said selecting means selects one of said plurality of sampled data stored in the memory.

24. A system according claim 22, wherein said characteristics determining means determines said characteristics respectively for all cylinders of said engine.

25. A system according to claim 24, wherein said engine has two cylinder banks such that pipes of said exhaust manifold connected to said exhaust ports of said plurality of cylinders are combined into two groups and merge into one in each group to form the confluence point of the exhaust system at which or downstream thereof said air/fuel ratio sensor is installed, and said characteristics determining means determines said characteristics for all cylinders in said two banks.

26. A system according to claim 25, wherein said selecting means selects one of said plurality of sampled data by retrieving said characteristics for said one cylinder.

27. A system according to claim 24, wherein said engine has two cylinder banks such that pipes of said exhaust manifold connected to said exhaust ports of said plurality of cylinders are combined into two groups and merge into one in each group to form the confluence point of the exhaust system at which downstream thereof said air/fuel ratio sensor is installed, and said characteristics determining means determines said characteristics for each cylinder pair in said two banks.

28. A system according to claim 27, wherein said selecting means selects one of said plurality of sampled data by retrieving said characteristics for said one cylinder.

29. A system according to claim 23, further including:

a mathematical model describing behavior of said exhaust system based on said outputs of said air/fuel ratio sensor;

estimating means for observing an internal state of the mathematical model and calculating an output which estimates an air/fuel ratio in each cylinder of said engine; and said air/fuel ratio determining means determines said air/fuel ratio of each cylinder of said engine based on said output of said estimating means.

30. A system according to claim 29, further including:

exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming means for assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix; and said estimating means estimates said air/fuel ratio in each cylinder from said state variable $\hat{X}$;

and said air/fuel ratio determining means determines said air/fuel ratio of each cylinder of said engine based on said estimated air/fuel ratio.

31. A system according claim 22, wherein said characteristics determining means determines said characteristics for at least one cylinder of said engine.

32. A system according to claim 31, wherein said engine has two cylinder banks such that pipes of said exhaust manifold connected to said exhaust ports of said plurality of cylinders are combined into two groups and merge into one in each group to form the confluence point of the exhaust system at which or downstream thereof said air/fuel ratio sensor is installed, and said characteristics determining means determines said characteristics for one cylinder pair in said two banks.

33. A system according to claim 32, wherein said selecting means selects one of said plurality of sampled data by retrieving said characteristics to increase/decrease a retrieved value corresponding to a difference from a desired cylinder to that of said one cylinder.

34. A system according to claim 31, further including:

storing means for storing said plurality of sampled data in a memory; and said selecting means selects one of said plurality of sampled data stored in the memory.

35. A system according to claim 31, further including:

a mathematical model describing behavior of said exhaust system based on said outputs of said air/fuel ratio sensor;

estimating means for observing an internal state of the mathematical model and calculating an output which estimates an air/fuel ratio in each cylinder of said engine;

and said air/fuel ratio determining means determines said air/fuel ratio of each cylinder of said engine based on said output of said estimating means.

36. A system according to claim 35, further including:

exhaust system behavior deriving means for deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming means for assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix; and said estimating means estimates said air/fuel ratio in each cylinder from said state variable $\hat{X}$;

and said air/fuel ratio determining means determines said air/fuel ratio of each cylinder of said engine based on said estimated air/fuel ratio.

37. A method for detecting air/fuel ratio of an internal combustion engine having a plurality of cylinders by sampling outputs of an air/fuel ratio sensor, said engine being provided with an exhaust manifold which is connected to exhaust ports of said plurality of cylinders and merges to a confluence point of an exhaust system at which or downstream thereof said air/fuel ratio sensor is installed, comprising the steps of:

(a) sampling said outputs of said air/fuel ratio sensor as a plurality of sampled data;

(b) determining characteristics for datum selection for at least one of said plurality of cylinders in response to distance from said air/fuel ratio sensor to the exhaust port of said one cylinder, with respect to operating parameters of said engine including at least engine speed and engine load;

(c) detecting said operating parameters of said engine;

(d) identifying said one cylinder of said engine;

(e) selecting one of said plurality of sampled data in accordance with said determined characteristics by said detected operating parameters of said engine; and (f) determining said air/fuel ratio of said engine based on said selected sampled datum.

38. A method according to claim 37, further including:

storing said plurality of sampled data in a memory; and selecting one of said plurality of sampled data stored in the memory.

39. A method according to claim 37, further including the step of determining said characteristics respectively for all cylinders of said engine.

40. A method according to claim 39, further comprising the steps of having two cylinder banks for said engine, combining pipes of said exhaust manifold connected to said exhaust ports of said plurality of cylinders into two groups and merging into one in each group to form the confluence point of the exhaust system at which or downstream thereof said air/fuel ratio sensor is installed, and determining said characteristics for all cylinders in said two banks.

41. A method according to claim 40, further comprising the step of selecting one of said plurality of sampled data by retrieving said characteristics for said one cylinder.

42. A method according to claim 39, further comprising the steps of having two cylinder banks of said engine, combining and merging pipes of said exhaust manifold connected to said exhaust ports of said plurality of cylinders into two groups and into one in each group to form the confluence point of the exhaust system at which or downstream thereof said air/fuel ratio sensor is installed, and determining said characteristics for each cylinder pair in said two banks.

43. A method according to claim 42, further comprising the step of selecting one of said plurality of sampled data is by retrieving said characteristics for said one cylinder.

44. A method according to claim 38, further including the steps of:

establishing a mathematical model describing behavior of said exhaust system based on said outputs of said air/fuel ratio sensor;

observing an internal state of the mathematical model and calculating an output which estimates an air/fuel ratio in each cylinder of said engine;

and determining said air/fuel ratio of each cylinder of said engine based on said calculated output.

45. A method according to claim 44, further including the steps of:

deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix;

estimating said air/fuel ratio in each cylinder from said state variable $\hat{X}$;

and determining said air/fuel ratio of each cylinder of said engine based on said estimated air/fuel ratio.

46. A method according to claim 37, further comprising the step of determining said characteristics for at least one cylinder of said engine.

47. A method according to claim 46, further comprising the step of having two cylinder banks of said engine, combining and merging pipes of said exhaust manifold connected to said exhaust ports of said plurality of cylinders into two groups and into one in each group to form the confluence point of the exhaust system at which downstream thereof said air/fuel ratio sensor is installed, and determining said characteristics for one cylinder pair in said two banks.

48. A method according to claim 47, further comprising the step of selecting one of said plurality of sampled data by retrieving said characteristics to increase/decrease a retrieved value corresponding to a difference from a desired cylinder to that of said one cylinder.

49. A method according to claim 46, further including the steps of:

storing said plurality of sampled data in a memory; and selecting one of said plurality of sampled data stored in the memory.

50. A method according to claim 46, further including the steps of:

establishing a mathematical model describing behavior of said exhaust system based on said outputs of said air/fuel ratio sensor;

observing an internal state of the mathematical model and calculating an output which estimates an air/fuel ratio in each cylinder of said engine;

and determining said air/fuel ratio of each cylinder of said engine based on said calculated output.

51. A method according to claim 50, further including the steps of:

deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix;

estimating said air/fuel ratio in each cylinder from said state variable $\hat{X}$;

determining said air/fuel ratio of each cylinder of said engine based on said estimated air/fuel ratio.

52. A computer program for detecting air/fuel ratio of an internal combustion engine having a plurality of cylinders by sampling outputs of an air/fuel ratio sensor, said engine being provided with an exhaust manifold which is connected to exhaust ports of said plurality of cylinders and merge to a confluence point of an exhaust system at which or downstream thereof said air/fuel ratio sensor is installed, comprising the steps of:

(a) sampling said outputs of said air/fuel ratio sensor as a plurality of sampled data;

(b) determining characteristics for datum selection for at least one of said plurality of cylinders in response to distance from said air/fuel ratio sensor to the exhaust port of said one cylinder, with respect to operating parameters of said engine including at least engine speed and engine load;

(c) detecting said operating parameters of said engine;

(d) identifying said one cylinder of said engine;

(e) selecting one of said plurality of sampled data in accordance with said determined characteristics by said detected operating parameters of said engine; and (f) determining said air/fuel ratio of said engine based on said selected sampled datum.

53. A computer program according to claim 52, further including:

storing said plurality of sampled data in a memory; and selecting one of said plurality of sampled data stored in the memory.

54. A computer program according claim 52, wherein said characteristics are determined respectively for all cylinders of said engine.

55. A computer program according to claim 53, further including:

establishing a mathematical model describing behavior of said exhaust system based on said outputs of said air/fuel ratio sensor;

observing an internal state of the mathematical model and calculating an output which estimates an air/fuel ratio in each cylinder of said engine;

and determining said air/fuel ratio of each cylinder of said engine based on said calculated output.

56. A computer program according to claim 55, further including:

deriving a behavior of said exhaust system in which X(k) is observed from a state equation and an output equation in which an input U(k) indicates said air/fuel ratio in each cylinder and an output Y(k) indicates an estimated air/fuel ratio as $$X(k+1)=AX(k)+BU(k)$$

$$Y(k)=CX(k)+DU(k)$$

where A, B, C and D are coefficient matrices;

assuming said input U(k) as a predetermined value to establish an equation using said output Y(k) as an input in which a state variable $\hat{X}$ indicates said air/fuel ratio in each individual cylinder as $$\hat{X}(k+1)=[A-KC]\hat{X}(k)+KY(k)$$

where K is a gain matrix;

estimating said air/fuel ratio in each cylinder from said state variable $\hat{X}$;

and determining said air/fuel ratio of each cylinder of said engine based on said estimated air/fuel ratio.

57. A computer program according claim 52, wherein said characteristics are determined for at least one cylinder of said engine.

* * * * *